US009644306B2

(12) United States Patent
Doh et al.

(10) Patent No.: US 9,644,306 B2
(45) Date of Patent: May 9, 2017

(54) CONTROL METHOD OF LAUNDRY MACHINE

(71) Applicants: Youngjin Doh, Changwon-si (KR); Hong Namgoong, Changwon-si (KR); Jihong Lee, Changwon-si (KR); Hyunchul Choi, Changwon-si (KR); Kyuhwan Lee, Changwon-si (KR); Taewan Kim, Changwon-si (KR)

(72) Inventors: Youngjin Doh, Changwon-si (KR); Hong Namgoong, Changwon-si (KR); Jihong Lee, Changwon-si (KR); Hyunchul Choi, Changwon-si (KR); Kyuhwan Lee, Changwon-si (KR); Taewan Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 561 days.

(21) Appl. No.: 13/758,157

(22) Filed: Feb. 4, 2013

(65) Prior Publication Data

US 2013/0198971 A1 Aug. 8, 2013

(30) Foreign Application Priority Data

| | | |
|---|---|---|
| Feb. 6, 2012 | (KR) | 10-2012-0011743 |
| Feb. 6, 2012 | (KR) | 10-2012-0011744 |
| Feb. 6, 2012 | (KR) | 10-2012-0011745 |
| Feb. 6, 2012 | (KR) | 10-2012-0011746 |
| Apr. 30, 2012 | (KR) | 10-2012-0045237 |

(Continued)

(51) Int. Cl.

*D06F 39/00* (2006.01)
*D06F 39/04* (2006.01)

(Continued)

(52) U.S. Cl.

CPC ..... *D06F 39/008* (2013.01); *D06F 25/00* (2013.01); *D06F 29/00* (2013.01); *D06F 33/02* (2013.01);

(Continued)

(58) Field of Classification Search

CPC ..... D06F 25/00; D06F 29/00; D06F 33/02; D06F 39/008; D06F 39/04; D06F 58/02; D06F 58/203; D06F 58/20; D06F 58/26; D06F 58/28; D06F 2058/2854; D06F 2058/289

See application file for complete search history.

(56) References Cited

U.S. PATENT DOCUMENTS

| | | | |
|---|---|---|---|
| 5,839,667 | A | 11/1998 | Fishcer |
| 6,129,154 | A | 10/2000 | Hoffmann et al. |

(Continued)

FOREIGN PATENT DOCUMENTS

| | | | |
|---|---|---|---|
| CN | 1534130 | A | 10/2004 |
| CN | 1680648 | A | 10/2005 |

(Continued)

*Primary Examiner* — Joseph L Perrin
(74) *Attorney, Agent, or Firm* — Dentons US LLP

(57) ABSTRACT

A method of controlling steam supply in a laundry machine. The control method includes heating a predetermined space within a duct in communication with a tub and/or drum of the laundry machine to a higher temperature than a temperature of the other space within the duct, directly supplying water to the heated predetermined space to generate steam, and supplying air flow toward the heated predetermined space so as to supply the generated steam into the laundry.

26 Claims, 23 Drawing Sheets

(30) Foreign Application Priority Data

May 31, 2012 (KR) ..... 10-2012-0058035
May 31, 2012 (KR) ..... 10-2012-0058037

(51) Int. Cl.

| | |
|---|---|
| ***D06F 29/00*** | (2006.01) |
| ***D06F 58/02*** | (2006.01) |
| ***D06F 33/02*** | (2006.01) |
| ***D06F 58/26*** | (2006.01) |
| ***D06F 58/28*** | (2006.01) |
| ***D06F 39/08*** | (2006.01) |
| ***D06F 58/20*** | (2006.01) |
| ***D06F 25/00*** | (2006.01) |

(52) U.S. Cl.

CPC ..... *D06F 39/04* (2013.01); *D06F 39/088* (2013.01); *D06F 58/02* (2013.01); *D06F 58/20* (2013.01); *D06F 58/203* (2013.01); *D06F 58/26* (2013.01); *D06F 58/28* (2013.01); *D06F 2058/289* (2013.01); *D06F 2058/2854* (2013.01)

(56) References Cited

U.S. PATENT DOCUMENTS

| | | | |
|---|---|---|---|
| 7,040,039 | B1 | 5/2006 | Stein et al. |
| 2004/0250442 | A1 | 12/2004 | Ryu |
| 2005/0223503 | A1 | 10/2005 | Hong et al. |
| 2005/0223504 | A1 | 10/2005 | Lee et al. |
| 2006/0005581 | A1 | 1/2006 | Banba |
| 2006/0101588 | A1 | 5/2006 | Park et al. |
| 2006/0162394 | A1 | 7/2006 | Kim et al. |
| 2007/0006484 | A1 | 1/2007 | Moschuetz et al. |
| 2007/0101773 | A1 | 5/2007 | Park et al. |
| 2007/0199353 | A1 | 8/2007 | Woo et al. |
| 2007/0283507 | A1 | 12/2007 | Wong et al. |
| 2007/0283509 | A1 | 12/2007 | Wong et al. |
| 2007/0283728 | A1 | 12/2007 | Wong et al. |
| 2008/0006300 | A1 | 1/2008 | Ahn et al. |
| 2008/0040868 | A1 | 2/2008 | Wong et al. |
| 2008/0282750 | A1 | 11/2008 | Yang et al. |
| 2008/0302138 | A1 | 12/2008 | Bae et al. |
| 2009/0038084 | A1 | 2/2009 | Lee et al. |
| 2009/0056036 | A1 | 3/2009 | Herkle et al. |
| 2009/0265953 | A1 | 10/2009 | Bae et al. |
| 2010/0115788 | A1 | 5/2010 | Kim et al. |
| 2011/0126596 | A1 | 6/2011 | Kim et al. |
| 2012/0159800 | A1 | 6/2012 | Del Pos et al. |

FOREIGN PATENT DOCUMENTS

| | | | |
|---|---|---|---|
| CN | 1680650 | A | 10/2005 |
| CN | 1696384 | A | 11/2005 |
| CN | 1969078 | A | 5/2007 |
| CN | 101146945 | A | 3/2008 |
| CN | 101158109 | A | 4/2008 |
| CN | 101305123 | A | 11/2008 |
| CN | 101307547 | A | 11/2008 |
| CN | 100494551 | C | 6/2009 |
| CN | 101466887 | A | 6/2009 |
| CN | 201809639 | U | 4/2011 |
| DE | 19743508 | A1 | 4/1999 |
| DE | 102007060854 | A1 | 6/2009 |
| EP | 1486605 | A1 | 12/2004 |
| EP | 1584728 | A1 | 10/2005 |
| EP | 1666655 | A2 | 6/2006 |
| EP | 1873297 | A2 | 1/2008 |
| EP | 1992730 | A1 | 11/2008 |
| EP | 2031114 | A1 | 3/2009 |
| EP | 2053155 | A1 | 4/2009 |
| EP | 2208819 | A1 | 7/2010 |
| EP | 2402498 | A1 | 1/2012 |
| EP | 2471998 | A1 | 7/2012 |
| GB | 2087029 | A | 5/1982 |
| JP | 64-049801 | A | 2/1989 |
| JP | 04-144598 | A | 5/1992 |
| JP | 04-144599 | A | 5/1992 |
| JP | 2005-296631 | A | 10/2005 |
| JP | 2005-304619 | A | 11/2005 |
| JP | 2006-109869 | | 4/2006 |
| JP | 2006-141986 | A | 6/2006 |
| JP | 2007-229189 | A | 9/2007 |
| JP | 2008534047 | A | 8/2008 |
| JP | 2008-200485 | A | 9/2008 |
| JP | 2008-307266 | | 12/2008 |
| JP | 2009-072491 | A | 4/2009 |
| JP | 2011-092428 | A | 5/2011 |
| JP | 2012-000313 | | 1/2012 |
| KR | 10-0531328 | B1 | 11/2005 |
| KR | 1020050123317 | A | 12/2005 |
| KR | 10-2006-0054887 | A | 5/2006 |
| KR | 1020060046025 | A | 5/2006 |
| KR | 10-2006-0102989 | A | 9/2006 |
| KR | 1020060096712 | A | 9/2006 |
| KR | 10-20060121403 | A | 11/2006 |
| KR | 100662473 | B1 | 12/2006 |
| KR | 10-2007-0003361 | A | 1/2007 |
| KR | 10-0672489 | B1 | 1/2007 |
| KR | 100698224 | B1 | 3/2007 |
| KR | 10-0712274 | B1 | 4/2007 |
| KR | 10-0762337 | B1 | 9/2007 |
| KR | 10-2007-0122252 | A | 12/2007 |
| KR | 1020070117911 | A | 12/2007 |
| KR | 10-2008-0032378 | A | 4/2008 |
| KR | 1020080101128 | A | 11/2008 |
| KR | 10-2009-0079560 | A | 7/2009 |
| KR | 10-2009-0105120 | A | 10/2009 |
| KR | 1020100102491 | A | 9/2010 |
| KR | 10-2011-0061115 | A | 6/2011 |
| RU | 2471025 | C2 | 9/2009 |
| WO | 2009077291 | A1 | 6/2009 |
| WO | 2011-000760 | A1 | 1/2011 |

FIG. 18A

| | PRE-TREATMENT PROCESS (P1) | | |

FIG. 18B

| | | |

FIG. 18C

| | DRYING PROCESS (P4) | | |

CONTROL METHOD OF LAUNDRY MACHINE

This application claims the benefit of Korean Patent Application No. 10-2012-0011743, filed on Feb. 6, 2012, Korean Patent Application No. 10-2012-0011744, filed on Feb. 6, 2012, Korean Patent Application No. 10-2012-0011745, filed on Feb. 6, 2012, Korean Patent Application No. 10-2012-0011746, filed on Feb. 6, 2012, Korean Patent Application No. 10-2012-0045237, filed on Apr. 30, 2012, Korean Patent Application No. 10-2012-0058035, filed on May 31, 2012 and Korean Patent Application No. 10-2012-0058037, filed on May 31, 2012, each of which is hereby incorporated by reference as if fully set forth herein.

BACKGROUND

Field

The present disclosure relates to a control method of a laundry machine, and more particularly to a control method of a steam supply mechanism of a laundry machine, e.g. a washing machine.

Discussion of the Related Art

Laundry machines include dryers for drying laundry, refreshers or finishers for refreshing laundry and washing machines for washing laundry. Generally, a washing machine is an apparatus that washes laundry using detergent and mechanical friction. Based upon configuration, and more particularly, based on the orientation of a tub that accommodates laundry, washing machines may be classified into a top-loading washing machine or a front-loading washing machine. In the top-loading washing machine, the tub is erected within a housing of the washing machine and has an entrance formed in a top potion thereof. Accordingly, laundry is put into the tub through an opening that is formed in a top portion of the housing and communicates with the entrance of the tub. In the front-loading washing machine, the tub faces upward within a housing and an entrance of the tub faces a front surface of the washing machine. Accordingly, laundry is put into the tub through an opening that is formed in a front surface of the housing and communicates with the entrance of the tub. In both the top-loading washing machine and the front-loading washing machine, a door is installed to the housing to open or close the opening of the housing.

The above described types of washing machines may have various other functions, in addition to a basic wash function. For example, the washing machines may be designed to perform drying as well as washing, and may further include a mechanism to supply hot air required for drying. Additionally, the washing machines may have a so-called laundry freshening function. To achieve the laundry freshening function, the washing machines may include a mechanism to supply steam to laundry. Steam is a vapor phase of water generated by heating liquid water; steam may have a high temperature and ensure easy supply of moisture to laundry. Accordingly, the supplied steam may be used, for example, for wrinkle-free, deodorization, and static charge elimination. In addition to the laundry freshening function, steam may also be used for sterilization of laundry owing to a high temperature and moisture thereof. When supplied during washing, steam creates a high temperature and high humidity atmosphere within a drum or a tub that accommodates laundry. This atmosphere may provide a considerable improvement in washing performance.

The laundry machines may adopt various methods to supply steam. For example, the laundry machines may apply a drying mechanism to steam generation. In the related art, there are laundry machines that the related art do not require an additional device for steam generation, and thus can supply steam to laundry without an increase in production costs. However, since these laundry machines of the related art do not propose optimized control or utilization of a drying mechanism, they have a difficulty in efficiently generating a sufficient amount of steam as compared to an independent steam generator that is configured to generate only steam. For the same reason, furthermore, the laundry machines of the related art cannot efficiently achieve desired functions, i.e. laundry freshening and sterilization and creation of an atmosphere suitable for washing as enumerated above.

SUMMARY

Accordingly, the present disclosure is directed to a control method of a laundry machine, e.g. a washing machine, that substantially obviates one or more problems due to limitations and disadvantages of the related art.

One object is to provide a control method of a laundry machine, e.g. a washing machine, capable of efficiently generating steam.

Another object is to provide a control method of a laundry machine, e.g. a washing machine, capable of effectively performing desired functions via supply of steam.

Various advantages, objects, and features will be set forth in part in the description which follows and in part will become apparent to those having ordinary skill in the art upon examination of the following or may be learned from practice of the invention. The objectives and other advantages may be realized and attained by the structure particularly pointed out in the written description and claims hereof as well as the appended drawings.

To achieve these objects and other advantages and in accordance with the purpose of the invention, as embodied and broadly described herein, a control method of a laundry machine such as a washing machine includes heating a predetermined space within a duct in communication with a tub of the laundry machine to a higher temperature than a temperature of the other space within the duct, directly supplying water to the heated predetermined space to generate steam, and supplying air flow towards the heated predetermined space so as to supply the generated steam to the laundry, i.e. into the tub and/or drum.

According to another aspect, a control method of a laundry machine such as a washing machine includes heating a predetermined space within a duct in communication with a tub and/or drum of the laundry machine to a higher temperature than a temperature of the other space within the duct, directly supplying water to the heated predetermined space to generate steam, and supplying air flow towards the heated predetermined space so as to supply the generated steam into the tub, wherein the supply of water begins after the heating is performed for a predetermined time, and the supply of air flow begins after the heating and the supply of water are performed for a predetermined time.

The heating may be performed without supplying water to the predetermined space, and may include actuating the blower installed in the duct for a predetermined time.

The supply of water may include directly ejecting mist toward the heating space.

Also, the supply of water may be performed with the supply of air flow to the predetermined space, and may be performed simultaneously with heating the predetermined space. Further, the heating may be additionally performed for at least a partial duration of the supply of water.

The supply of air flow may be performed simultaneously with the heating and the supply of water to the predetermined space. The heating may be additionally performed for at least a partial duration of the supply of air flow, and the supply of water may be additionally performed for at least a partial duration of the supply of air flow.

A set of the heating, the supply of water, and the supply of air flow may be repeated a plurality of times.

The control method of the laundry machine may further include preliminary heating of at least the entire duct before the heating. Also, the control method of the laundry machine may further include discharging at least water remaining in the laundry machine before the heating. The control method of the laundry machine may further include cleaning the heater within the duct before the heating.

The control method of the laundry machine may further include performing a first drying to supply heated air into the tub for a predetermined time, and performing a second drying to supply heated air into the tub, the heated air of the second drying having a higher temperature than a temperature of the air in the first drying, the first drying and the second drying being performed after the steam supply. The control method of the laundry machine may further include cooling laundry by circulating unheated air after the second drying.

The control method of the laundry machine may further include judging the amount of water supplied into the predetermined space based on a temperature increase rate within the duct for a predetermined time before the heating. More specifically, the judgment may include generating steam in the predetermined space of the duct for the predetermined time, and determining the temperature increase rate of air discharged from the predetermined space for the predetermined time.

When it is judged that a sufficient amount of water is not supplied, the control method of the laundry machine may further include performing a third drying to supply heated air into the tub while intermittently actuating the heater mounted in the duct. The control method of the laundry machine may further include performing a fourth drying to supply heated air into the tub after implementation of the third drying, the heated air of the fourth drying having a higher temperature than a temperature of the air in the third drying. The control method of the laundry machine may further include cooling laundry by circulating unheated air after the fourth drying. Further, the control method of the laundry machine may include repeating the heating, the supply of water, and the supply of air flow a preset number of times if it is judged that a sufficient amount of water is supplied.

The control method of the laundry machine may further include pausing actuation of the laundry machine for a predetermined time after judgment and before the heating, and pausing actuation of the laundry machine for a predetermined time before the first drying.

In accordance with a further aspect, a control method of a laundry machine, the laundry machine comprising a duct in communication with a tub, a heater installed in the duct to be exposed to air therein, a nozzle and a blower which are each installed within the duct, and a controller comprises activating, via the controller, the heater to produce heat, performing a steam generation by directly supplying water to the heater using the nozzle, and initiating, via the controller, a steam supply comprising generating air flow within the duct by rotating the blower, and supplying the generated steam into the tub, wherein the steam supply at least includes a duration for which simultaneous actuation of the heater, the nozzle, and the blower is performed.

In this case, the heater activation, the steam generation, and the steam supply may be performed in sequence.

That is, the steam supply may be performed after the steam generation is completely performed. Likewise, the steam generation may be performed after completing the heater activation.

Meanwhile, an actuation time of the nozzle during the steam generation may be longer than an actuation time of the nozzle during the steam supply. That is, since the actuation time of the nozzle is set to a longer value in the steam generation, a greater amount of steam than in the steam supply may be generated.

In this case, the actuation time of the nozzle during the steam supply may be a half to a quarter of the actuation time of the nozzle during the steam generation, and preferably may be in a half to one third of the actuation time of the nozzle during the steam generation.

The heater, the nozzle, and the blower may be simultaneously actuated for the duration of the steam supply. That is, in the steam supply, steam may be generated as water is continuously ejected to the heater by the nozzle in a state in which the heater is continuously heated. The air flow may be supplied into the duct via actuation of the blower during generation of steam. For example, if the steam supply is set to 10 seconds, the heater may be actuated for 10 seconds, and ejection of water by the nozzle may be achieved, and the air flow may be supplied via actuation of the blower.

On the other hand, when the heater, the nozzle, and the blower are simultaneously actuated by the controller for a partial duration of the steam supply, the simultaneous actuation by the controller may be performed during the final stage of the steam supply.

The steam generation may include stopping, with the controller, actuation of the blower. In this case, although stopping the blower may be performed only for at least a partial duration of the steam generation, actuation of the blower may stop for the duration of the steam generation. In the steam generation, actuation of the heater may be maintained. Even in this case, actuation of the heater, by the controller, may be maintained for at least a partial duration of the steam generation, but may be maintained for the duration of the steam generation.

In the heater activation, actuation of the nozzle and the blower may stop. Actuation of the nozzle may stop for the duration of the heater activation, and actuation of the blower may stop for at least a partial duration or for the duration of the heater activation. If actuation of the blower is performed for a partial duration of the heater activation, actuation of the blower may stop at the initial stage of the heater activation, and may be maintained at the final stage of the heater activation.

The control method of the laundry machine may further include preliminarily rotating, via the controller, the blower installed in the duct before the steam supply. The preliminary rotation may be performed at the final stage of the heater activation.

In the heater activation, actuation by the controller of the nozzle, the heater, and the blower in the first heating may be differently controlled from that in the second heating. The heater activation may include performing first heating to heat only the heater without actuation of the nozzle and the blower, and performing second heating to heat the heater while actuating the blower installed in the duct.

In this case, actuation by the controller of the nozzle may stop in the second heating.

The steam generation and the steam supply may include discharging water, generated by supply of the steam, from the tub. The discharge may be performed by discharging water in the tub to the outside of the laundry machine via actuation of a drain pump.

A steam supply process comprising the heater activation, the steam generation, and the steam supply may be repeated a plurality of times.

The control method of the laundry machine may further comprising actuating, via the controller, the heater to circulate high temperature air through the duct before the heater activation.

The control method of the laundry machine may further comprise discharging water remaining in the laundry machine before the heater activation.

The control method of the laundry machine may further include cleaning the heater within the duct before the heater activation. The cleaning may be performed by ejecting water to the heater using the nozzle.

A drying process may be performed after the steam supply. The drying process may include performing a first drying to supply heated air into the tub for a predetermined time, and performing a second drying to supply heated air into the tub, the heated air having a higher temperature than a temperature of the air in the first drying.

In this case, the duration of the first drying may be set to be longer than the duration of the second drying.

Implementation of the first drying may include intermittently actuating, via the controller, the heater installed within the duct, and implementation of the second drying may include continuously actuating the heater.

The control method of the laundry machine may further include cooling laundry by circulating unheated air after the second drying.

The steam generation and the steam supply may include ejecting water from the nozzle to the heater, the nozzle being located between the heater and the blower.

The nozzle may eject water in approximately the same direction as a direction of the air flow within the duct.

The nozzle may eject water to the heater by ejection pressure thereof.

The nozzle may eject mist to the heater.

The heater may be installed so as to be exposed to air within the duct, and the blower may be actuated to allow the air within the duct to be supplied into the tub by passing through the heater. That is, the heater may serve to generate heated air, and may be exposed to the air present within the duct. In addition, the heater may serve to generate steam by ejecting water to the heater within the duct.

The above described control method of the laundry machine may be applied to a laundry machine, in particular to a washing machine that will be described hereinafter.

According to another aspect of the present invention, a laundry machine such as a washing machine includes a tub to store wash water and/or a drum to accommodate laundry, the drum being rotatably provided in the tub, a duct in communication with the tub, a heater installed in the duct, a nozzle installed in the duct, the nozzle supplying water to the heater to generate steam, and a blower installed in the duct, the blower blowing air towards the heater.

According to another aspect, a laundry machine such as a washing machine includes a tub to store wash water and/or drum to accommodate laundry, the drum being rotatably provided in the tub, a duct in communication with the tub, a heater installed in the duct and configured to heat only a predetermined space within the duct, a nozzle installed in the duct, the nozzle directly supplying water to the heated predetermined space to generate steam, a blower installed in the duct, the blower blowing air toward the predetermined space to supply the generated steam into the tub, and a recess formed in the duct to accommodate a predetermined amount of water such that the water in the recess is heated for steam generation.

According to another aspect, a laundry machine such as a washing machine includes a tub to store wash water and/or drum to accommodate laundry, the drum being rotatably provided in the tub, a duct in communication with the tub, a heater installed in the duct and configured to heat only a predetermined space within the duct, a nozzle installed in the duct and directly supplying water to the heated predetermined space so as to generate steam, the nozzle having a separate water swirling device fitted therein, and a blower installed in the duct, the blower blowing air towards the predetermined space so as to supply the generated steam into the tub.

The nozzle may include a head having a water ejection opening and a body integrally formed with the head, the body being configured to guide water to the head. The swirling device may be fitted into the body.

The swirling device may include a conical core extending along the center axis of the swirling device, and a flow-path spirally extending around the core.

The nozzle may further include a positioning structure to determine a position of the swirling device. More specifically, the positioning structure may include a recess formed in any one of the nozzle and the swirling device, and a rib formed at the other one of the nozzle and the swirling device, the rib being inserted into the recess.

According to another aspect, a laundry machine such as a washing machine includes a tub to store wash water and/or a drum to accommodate laundry, the drum being rotatably provided in the tub, a duct in communication with the tub, a heater installed in the duct and adapted to be heated upon receiving power, at least one nozzle installed in the duct, the nozzle directly ejecting water to the heated heater by ejection pressure thereof, and a blower installed in the duct, the blower generating air flow within the duct, the air flow supplying steam into the tub, wherein the nozzle ejects water in approximately the same direction as the direction of air flow.

In this case, the nozzle may be provided between the heater and the blower.

Representing an installation position of the nozzle in consideration of an extending direction of the duct, the heater may be located at one longitudinal side of the duct, and the blower may be located at the other longitudinal side of the duct, and the nozzle may be located between the heater and the blower.

When the nozzle is provided between the heater and the blower, the nozzle may be spaced apart from the heater by a predetermined distance close to the blower. That is, the nozzle may be located between the heater and the blower, and may be located closer to the blower than the heater.

In other words, the nozzle may be installed close to a discharge portion through which air having passed through the blower is discharged.

The nozzle may be installed in a blower housing surrounding the blower.

Here, the blower housing may include an upper housing and a lower housing, and the nozzle may be installed in the upper housing.

To install the nozzle, the upper housing may have an aperture into which the nozzle is inserted.

The nozzle may include a body and a head, and the head may be inserted into the aperture and be located within the duct. In addition, a portion of the body close to the head may be inserted into the aperture and be located within the duct. In this case, the longitudinal direction of the body may coincide with the ejection direction of the nozzle.

The at least one nozzle may include a plurality of nozzles. Each of the plurality of nozzles may include a body and a head, and the plurality of nozzles may be connected to one another via a flange.

The flange may have a fastening hole facilitating connection to the duct. Accordingly, the flange may be fixed to the duct as a fastening member (for example, a screw or a bolt) is coupled into the fastening hole. As such, the plurality of nozzles coupled to the flange may be fixed.

The nozzle may directly eject mist to the heater. Although the nozzle may supply a water jet to the heater, mist may be ejected to the heater for more efficient and rapid steam generation. Also, the nozzle may enable steam generation without water loss by directly supplying water to the heater.

The nozzle may include a spirally extending flow-path therein.

The laundry machine may further include a recess formed in the duct to accommodate a predetermined amount of water such that the water in the recess is heated for steam generation.

The recess may be located below the heater. In this case, the recess may be located immediately below the heater.

At least a portion of the heater may have a bent portion that is bent downward toward the recess. In this case, the bent portion may be located in the recess. Accordingly, when water is collected in the recess, the bent portion may contact the water in the recess.

Differently from the method in which the heater directly contacts the water collected in the recess using the bent portion thereof, the water collected in the recess may be indirectly heated.

To realize the indirect heating, the laundry machine may further include a thermal conductive member coupled to the heater to transfer heat of the heater. In this case, at least a portion of the thermal conductive member may be located in the recess.

The thermal conductive member may include a heat sink mounted to the heater, at least a portion of the heat sink being located in the recess.

The recess may be located below a free end of the heater. This arrangement of the recess may be applied to both direct heating and indirect heating.

According to another aspect, a laundry machine includes a tub to store wash water and/or a drum to accommodate laundry, the drum being rotatably provided in the tub, a duct configured to communicate with the tub, a heater installed in the duct and adapted to be heated upon receiving power, a nozzle installed in the duct, the nozzle directly ejecting water to the heated heater by ejection pressure thereof, and a blower installed in the duct, the blower generating air flow within the duct, the air flow supplying the generated steam to the tub, wherein the nozzle is located between the heater and the blower and ejects water in approximately the same direction as the direction of air flow.

Explaining the arrangement of the above described configuration along the direction of the air flow within the duct, the blower, the nozzle, and the heater may be arranged in sequence. That is, if air flow occurs by rotation of the blower, the air discharged from the blower may pass the installation position of the nozzle and may reach the heater. In this case, the air having passed through the heater may be supplied to the laundry, i.e., into the tub and/or drum. In particular, the nozzle may be installed to an upper portion of the blower housing surrounding the blower, more specifically, to an upper housing of the blower housing.

The above described respective features of the laundry machine may be individually applied to the laundry machine, or combinations of at least two features may be applied to the laundry machine, e.g, drying and/or washing machine.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the invention, and together with the description serve to explain the principle of the invention. In the drawings:

FIGS. 18A to 18C are time charts illustrating the control method of FIG. 16;

DETAILED DESCRIPTION

Figure 1:
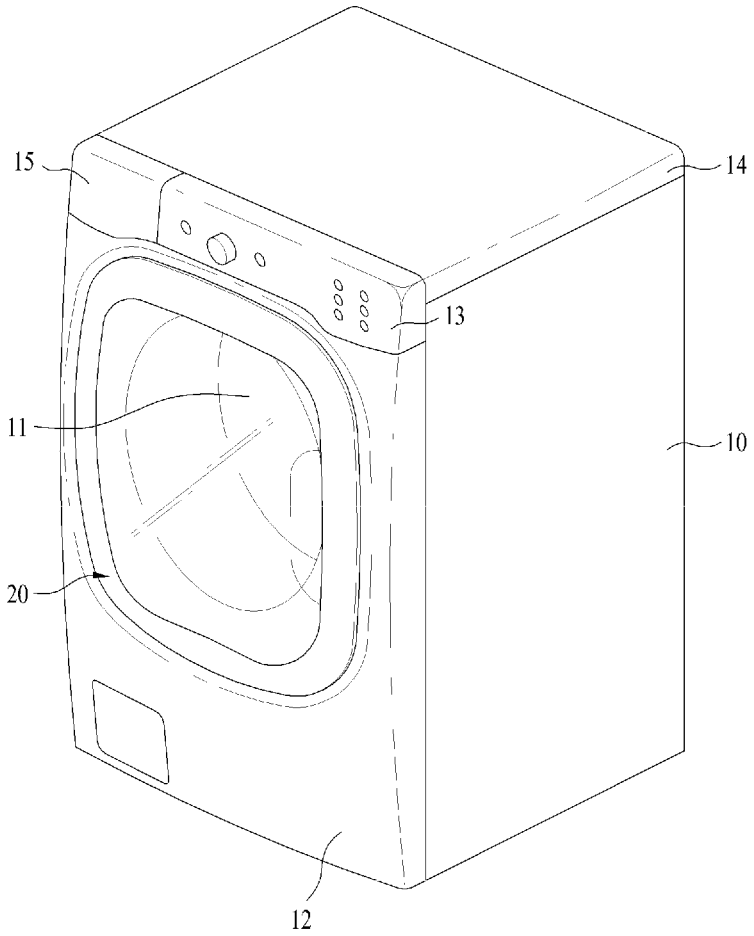
FIG. 1 is a perspective view illustrating a washing machine according to an embodiment of the present invention.

Hereinafter, exemplary embodiments of the present invention provided to realize the above described objects will be described with reference to the accompanying drawings. Although the present disclosure is described with reference to a front-loading washing machine as illustrated in the drawings, the present disclosure may be applied to a top-loading washing machine without substantial modifications.

In the following description, the term 'actuation' refers to applying power to a relevant component to realize a function of the relevant component. For example, 'actuation' of a heater refers to applying power to the heater to realize heating. In addition, an 'actuation section' of the heater refers to a section in which power is applied to the heater. When interrupting power applied to the heater, this refers to shutdown of 'actuation' of the heater. This is equally applied to a b lower and a nozzle.

Figure 2:
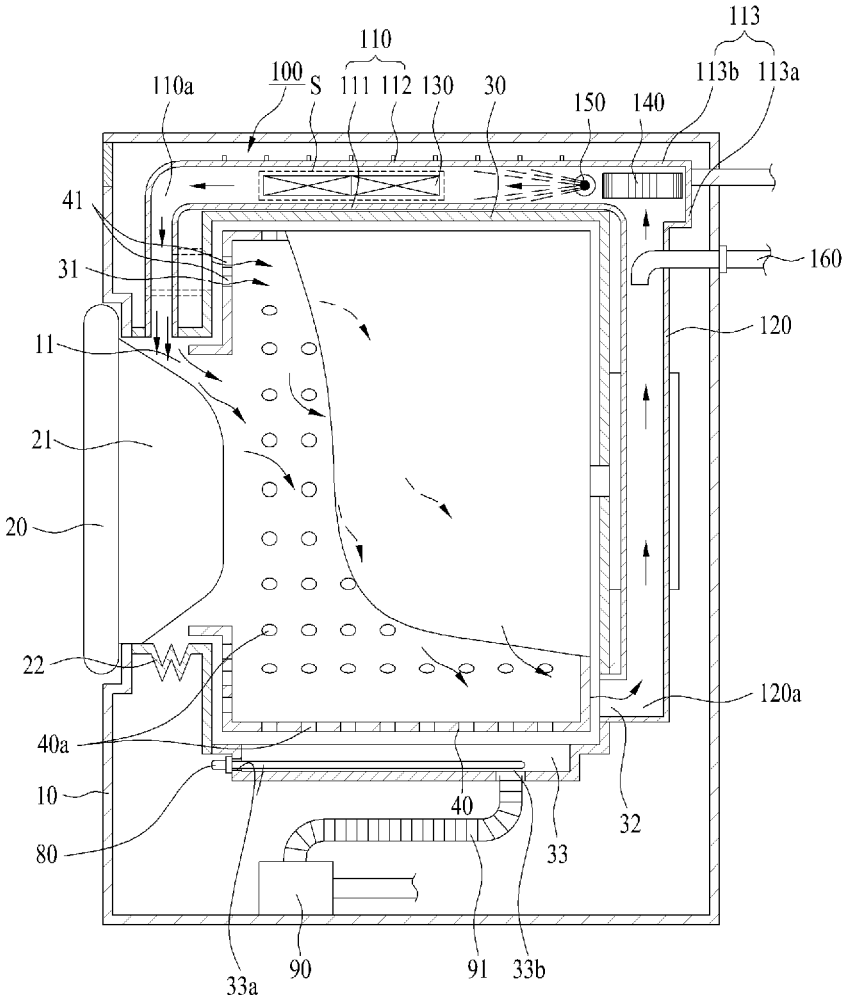
FIG. 2 is a sectional view illustrating the washing machine of FIG. 1.

FIG. 1 is a perspective view illustrating a washing machine according to an embodiment of the present invention, and FIG. 2 is a sectional view illustrating the washing machine of FIG. 1.

As illustrated in FIG. 1, the washing machine may include a housing 10 that defines an external appearance of the washing machine and accommodates elements required for actuation. Housing 10 may be shaped to surround the entire washing machine. However, to ensure easy disassembly for the purpose of repair, as illustrated in FIG. 1, housing 10 is shaped to surround only a portion of the washing machine. Instead, a front cover 12 is mounted to a front end of housing 10 so as to define a front surface of the washing machine. A control panel 13 is mounted above front cover 12 for manual operation of the washing machine. A detergent box 15 is mounted in an upper region of the washing machine. Detergent box 15 may take the form of a drawer that accommodates detergent and other additives for washing of laundry and is configured to be pushed into and pulled from the washing machine. Additionally, a top plate 14 is provided at housing 10 to define an upper surface of the washing machine. In combination with housing 10, front cover 12, top plate 14, and control panel 13 define the external appearance of the washing machine, and may be considered as constituent parts of housing 10. Housing 10, more specifically, front cover 12 has a front opening 11 located therein. Opening 11 is opened and closed by a door 20 that is also installed to housing 10. Although door 20 generally has a circular shape, as illustrated in FIG. 1, door 20 may be fabricated to have a substantially square shape. Square door 20 provides a user with a better view of opening 11 and an entrance of a drum (not shown), which is advantageous in terms of improving the external appearance of the washing machine. As illustrated in FIG. 2, door 20 is provided with a door glass 21. The user can view the interior of the washing machine through door glass 21 to check the state of laundry.

Referring to FIG. 2, a tub 30 and a drum 40 are installed within housing 10. Tub 30 is installed to store wash water within housing 10. Drum 40 is rotatably installed within tub 30. Tub 30 may be connected to an external water source to directly receive water required for washing. Additionally, tub 30 may be connected to detergent box 15 via a connection member such as a tube or a hose, and may receive detergent and additives from detergent box 15. Tub 30 and drum 40 are oriented such that entrances thereof face the front side of housing 10. The entrances of tub 30 and drum 40 communicate with the above mentioned opening 11 of housing 10. As such, once door 20 is opened, the user can put laundry into drum 40 through opening 11 and the entrances of tub 30 and drum 40. To prevent leakage of laundry and wash water, a gasket 22 is provided between opening 11 and tub 30. Tub 30 may be formed of plastic, in order to achieve a reduction in the material costs and the weight of tub 30. On the other hand, drum 40 may be formed of a metal to achieve sufficient strength and rigidity in consideration of the fact that drum 40 must accommodate heavy wet laundry and shock due to laundry is repeatedly applied to drum 40 during washing. Drum 40 has a plurality of through-holes 40*a* to allow wash water of tub 30 to be introduced into drum 40. A power device is installed around tub 30 and is connected to drum 40. Drum 40 is rotated by the power device. In general, the washing machine, as illustrated in FIG. 2, includes tub 30 and drum 40, which are oriented to have a center shaft that is substantially horizontal to an installation floor. However, the washing machine may include tub 30 and drum 40, which are obliquely oriented upward. That is, the entrances of tub 30 and drum 40 (i.e. front portions) are located higher than rear portions of tub 30 and drum 40. In such an embodiment, the entrances of tub 30 and drum 40 as well as opening 11 and door 20 associated with the entrances are located higher than the entrances, opening 11, and door 20 illustrated in FIG. 2. Accordingly, the user can put or pull laundry into or from the washing machine without bending his/her waist.

To further improve washing performance of the washing machine, hot or warm wash water is required based on the kind and state of laundry. To this end, the washing machine of the present disclosure may include a heater assembly including a heater 80 and a sump 33 to generate hot or warm wash water. The heater assembly, as illustrated in FIG. 2, is provided in tub 30, and serves to heat wash water stored in tub 30 to a desired temperature. Heater 80 is configured to heat wash water, and sump 33 is configured to accommodate heater 80 and wash water.

Referring to FIG. 2, the heater assembly may include heater 80 configured to heat wash water. The heater assembly may further include sump 33 configured to accommodate heater 80. Heater 80, as illustrated, may be inserted into tub 30, and more specifically, into sump 33 through an aperture 33*a* that is formed in sump 33 and has a predetermined size. Sump 33 may take the form of a cavity or a recess that is integrally formed in the bottom of tub 30. Accordingly, sump 33 has an open top and internally defines a predetermined size of space to accommodate some of wash water supplied into tub 30. Sump 33, as described above, is formed in the bottom of tub 30 which is advantageous to discharge the stored wash water. Therefore, a drain hole 33*b* is formed in the bottom of sump 33 and is connected to a drain pump 90 through a drain pipe 91. As such, the wash water within tub 30 may be discharged outward from the washing machine through drain hole 33*b*, drain pipe 91, and drain pump 90. Alternatively, drain hole 33*b* may be formed in another location of tub 30, instead of the bottom of sump 33. Through provision of sump 33 and heater 80, the washing machine may function to heat wash water so as to utilize the resulting hot or warm wash water for the washing of laundry.

Meanwhile, the washing machine may be configured to dry washed laundry for user convenience. To this end, the washing machine may include a drying mechanism to generate and supply hot air. As the drying mechanism, the washing machine may include a duct 100 configured to communicate with tub 30. Duct 100 is connected at both ends thereof to tub 30, such that interior air of tub 30 as well as interior air of drum 40 may circulate through duct 100. Duct 100 may have a single assembly configuration, or may be divided into a drying duct 110 and a condensing duct 120. Drying duct 110 is basically configured to generate hot air for drying of laundry, and condensing duct 120 is configured to condense moisture contained in the circulating air having passed through the laundry.

First, drying duct 110 may be installed within housing 10 so as to be connected to condensing duct 120 and tub 30. A heater 130 and a blower 140 may be mounted in drying duct 110. Condensing duct 120 may also be disposed within housing 10 and may be connected to drying duct 110 and tub 30. Condensing duct 120 may include a water supply device 160 to supply water so as to enable condensation and removal of moisture from the air. Drying duct 110 and condensing duct 120, i.e. duct 100, as described above, may be basically disposed within housing 10, but may partially be exposed to the outside of housing 10 as necessary.

Drying duct 110 may serve to heat air around heater 130 using heater 130, and may also serve to blow the heated air toward tub 30 and drum 40 disposed within tub 30 using blower 140. Heater 130 is installed so as to be exposed to the air within duct 100 (more specifically, within drying duct 110). As such, hot and dry air may be supplied from drying duct 110 into drum 40 by way of tub 30, in order to dry laundry. Also, since blower 140 and heater 130 are actuated together, new unheated air may be supplied to heater 130 by blower 140, and thereafter may be heated while passing through heater 130 so as to be supplied into tub 30 and drum 40. That is, supply of the hot and dry air may be continuously performed by simultaneous actuation of heater 130 and blower 140. Meanwhile, the supplied hot air may be used to dry the laundry, and thereafter may be discharged from drum 40 into condensing duct 120 through tub 30. In condensing duct 120, moisture is removed from the discharged air using water supply device 160, whereby dry air is generated. The resulting dry air may be supplied to drying duct 110 so as to be reheated. This supply may be realized by a pressure difference between drying duct 110 and condensing duct 120 that is caused by actuation of blower 140. That is, the discharged air may be changed into hot and dry air while passing through drying duct 110 and condensing duct 120. As such, the air within the washing machine is continuously circulated through tub 30, drum 40, and condensing and drying ducts 120 and 110, thereby being used to dry the laundry. In consideration of the circulation flow of the air as described above, an end of duct 100 that supplies the hot and dry air, i.e. an end or an opening of drying duct 110 that communicates with tub 30 and drum 40 may serves as a discharge portion or a discharge hole 110*a* of duct 100. The end of duct 100, to which wet air is directed, i.e. an end or an opening of condensing duct 120 that communicates with tub 30 and drum 40 may serve as a suction portion or a suction hole 120*a* of duct 100.

Drying duct 110, and more specifically, discharge portion 110*a*, as illustrated in FIG. 2, may be connected to gasket 22 so as to communicate with tub 30 and drum 40. On the other hand, as represented by a dotted line in FIG. 2, drying duct 110, and more specifically, discharge portion 110*a* may be connected to an upper front region of tub 30. In this case, tub 30 may be provided with a suction port 31 that communicates with drying duct 110, and drum 40 may be provided with a suction port 41 that communicates with drying duct 100. Also, condensing duct 120, i.e. suction portion 120*a* may be connected to the rear portion of tub 30. To communicate with condensing duct 120, tub 30 may be provided at a lower rear region thereof with a discharge port 32. Owing to connection positions between drying and condensing ducts 110 and 120 and tub 30, the hot and dry air may flow within drum 40 from the front portion to the rear portion of drum 40 as represented by the arrows in FIG. 2. More specifically, the hot and dry air may flow from the upper front region of drum 40 to the lower rear region of drum 40. That is, the hot and dry air may flow in a diagonal direction within drum 40. As a result, drying and condensing ducts 110 and 120 may be configured to allow the dry and hot air to completely pass across the space within drum 40 owing to appropriate mounting positions thereof. As such, the hot and dry air may be uniformly diffused within the entire space within drum 40, which may result in a considerable improvement in drying efficiency and performance.

Figure 3:
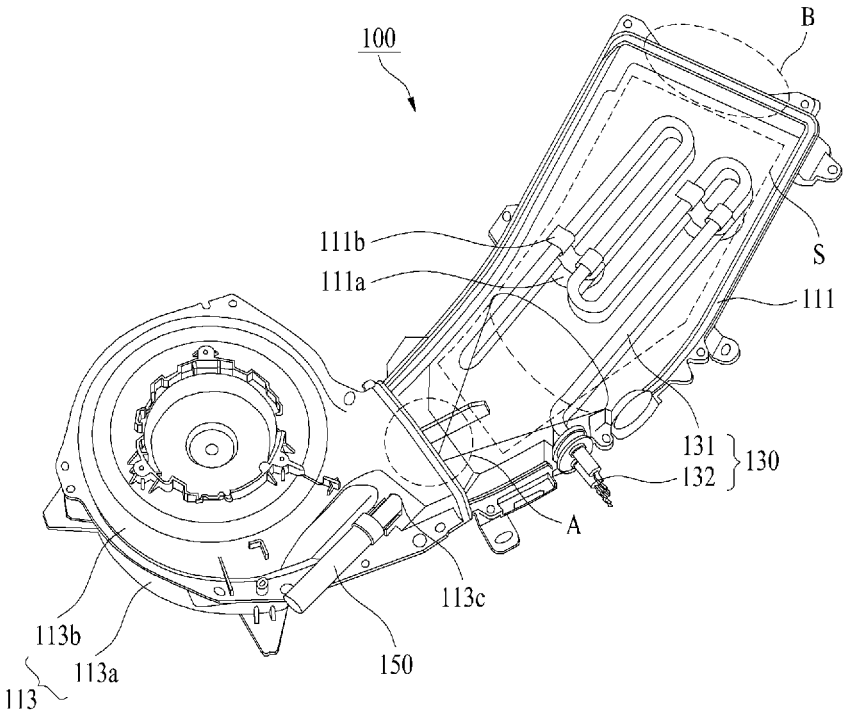
FIG. 3 is a perspective view illustrating a duct included in the washing machine according to an embodiment of the present invention.
Figure 4:
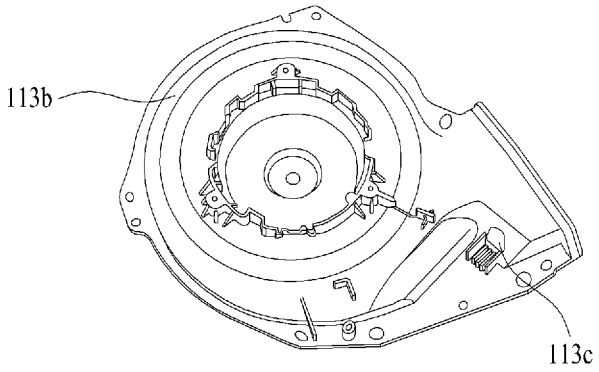
FIG. 4 is a perspective view illustrating a blower housing of the duct illustrated in FIG. 3.
Figure 5:
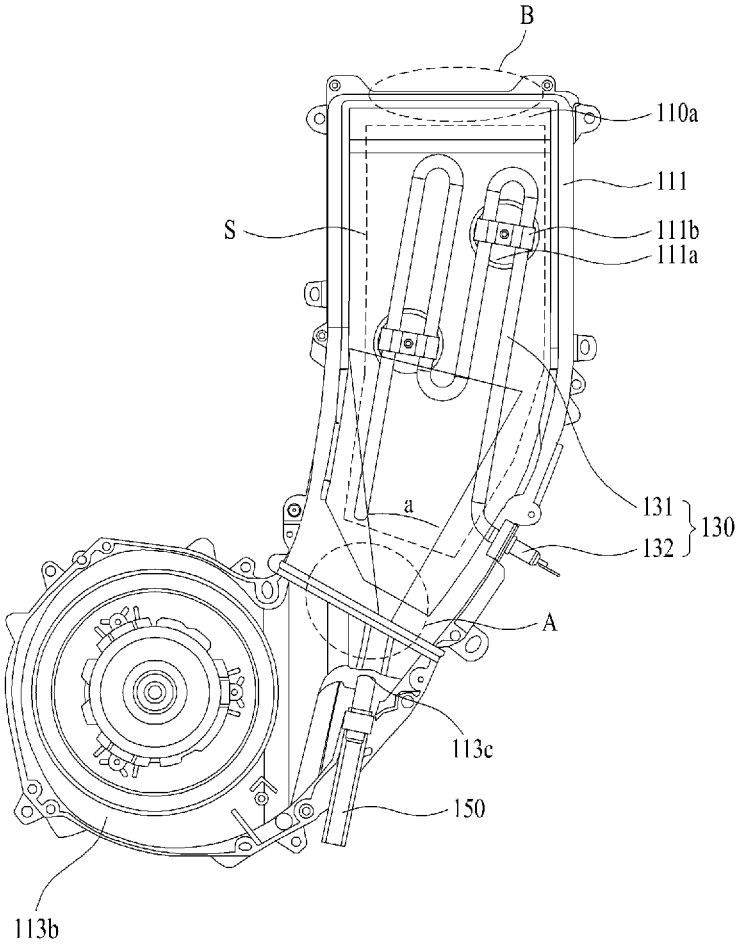
FIG. 5 is a plan view illustrating the duct of the washing machine.

Duct 100 is configured to accommodate various elements. To ensure easy installation of the elements, duct 100, i.e. drying and condensing ducts 110 and 120 may be composed of separable parts. In particular, most elements, for example, heater 130 and blower 140 are linked to drying duct 110, and therefore drying duct 110 may be composed of separable parts. Such a separable configuration of drying duct 110 provide easy removal of interior elements from drying duct 110 for the purpose of repair. More specifically, drying duct 110 may include a lower part 111. Lower part 111 substantially has a space therein, such that the elements may be accommodated in the space. Drying duct 110 may further include a cover 112 configured to cover lower part 111. Lower part 111 and cover 112 may be fastened to each other using a fastening member. Duct 100 may include a blower housing 113 configured to stably accommodate blower 140 that is rotated at high speeds. Blower housing 113 may also be composed of separable parts for easy installation and repair of blower 140. Blower housing 113 may include a lower housing 113*a* configured to accommodate blower 140 and an upper housing 113*b* configured to cover lower housing 113*a*. Except for upper housing 113*b* to be separated, lower housing 113*a* may be integrally formed with lower part 111 of drying duct 110 to reduce the number of elements of duct 100. FIGS. 3 to 5 illustrate lower part 111 and lower housing 113*a*, which are integrated with each other. In this case, it can be said that drying duct 110 is integrated with blower housing 113, and thus drying duct 110 accommodates blower 140. On the other hand, lower housing 113*a* may be integrally formed with condensing duct 120. Drying duct 110 is used to generate and transport high temperature air, and requires high heat resistance and thermal conductivity. Also, housing 113*a* must stably support blower 140 that is rotated at high speeds, and therefore must have high strength and rigidity. Accordingly, lower housing 113*a* and lower part 111, which are integrated with each other, may be formed of a metal. On the other hand, owing to lower housing 113*a* and lower part 111 which are formed of a metal to satisfy particular requirements, cover 112 and upper housing 113*b* may be formed of plastic to reduce the weight of drying duct 110.

Moreover, the washing machine according to the present disclosure may be configured to supply steam to laundry, in order to provide the user with a wider array of functions. As discussed above in relation to the related art, supply of steam has the effects of wrinkle-free, deodorization, and static charge elimination, thus allowing laundry to be freshened. Also, steam may serve to sterilize laundry and to create an ideal atmosphere for washing. These functions may be performed during a basic wash course of the washing machine, whereas the washing machine may have a separate process or course optimized to perform the functions. The washing machine may include an independent steam generator that is designed to generate only steam, to realize the aforementioned functions via supply of steam. However, the washing machine may utilize a mechanism provided for other functions as a mechanism to generate and supply steam. For example, as described above, the drying mechanism includes heater 130 as a heat source, and duct 100 and blower 140 as transportation means of air to tub 30 and drum 40, and thus may also be utilized to supply steam as well as hot air. Nevertheless, to realize supply of steam, it is necessary to slightly modify a conventional drying mechanism. The drying mechanism modified for supply of steam will be described hereinafter with reference to FIGS. 3 to 15. Of these drawings, FIGS. 3, 5, 9, 12, and 14 illustrate duct 100 from which cover 112 is removed to more clearly show the interior configuration of duct 100.

First, for supply of steam, it is necessary to create a high temperature environment suitable for steam generation. Accordingly, heater 130 may be configured to heat air within duct 100. As known, air has low thermal conductivity. Therefore, if the washing machine does not provide a means to forcibly transfer heat emitted from heater 130 to other regions of duct 100, for example, does not provide air flow by blower 140, heater 130 may function to heat only a space occupied by heater 130 and the surrounding space. Accordingly, heater 130 may heat a local space within duct 100 to a high temperature for supply of steam. That is, heater 130 may heat a partial space within duct 100, i.e. a predetermined space S to a higher temperature than that of the remaining space of duct 100. More specifically, to achieve such heating to a higher temperature, heater 130 may be adapted to heat only predetermined space S in a direct heating manner. In this case, predetermined space S may be referred to as heater 130. That is, heater 130 and predetermined space S may occupy the same space. Alternatively, predetermined space S may include a space occupied by heater 130 and the surrounding space within the duct 100 close to heater 130. That is, predetermined space S is a concept including heater 130. To achieve local and direct heating to a higher temperature, heater 130 may rapidly create an environment suitable for steam generation.

Heater 130 is installed in duct 100 (more particularly, in drying duct 110) and is heated upon receiving electric power. Heater 130, as illustrated in FIGS. 3 and 5, may basically include a body 131. Body 131 may substantially be located in duct 100 and serve to generate heat for heating of air. To this end, body 131 may adopt various heating mechanisms, but may generally take the form of a hot wire. More specifically, body 131 may be a sheath heater having a waterproof configuration to prevent breakdown of heater 130 due to moisture that may accumulate in duct 100. Preferably, body 131 may be bent plural times in the same plane to maximize generation of heat in a narrow space. Heater 130 may include a terminal 132 electrically connected to body 131 to apply electric power to body 131. Terminal 132 may be located at a distal end of body 131. Terminal 132 may be located at the outside of duct 100 for connection with an external power source. A sealing member may be interposed between body 131 and terminal 132 to hermetically seal duct 100 so as to prevent leakage of air and steam from duct 100.

Heater 130 may be fixed to the bottom of duct 100 (more specifically, to lower part 111 of drying duct 110) using a bracket 111*b*. In connection with bracket 111*b*, a boss 111*a* may also be provided at the bottom of duct 100. Boss 111*a* may protrude from the bottom of duct 100 by a predetermined length. A pair of bosses 111*a* may be provided at both sides of the bottom of duct 100 respectively. Bracket 111*b* may be fastened to boss 111*a* to fix heater 130. Moreover, bracket 111*b* may be configured to support body 131 of heater 130. Bracket 111*b*, as illustrated, may extend across body 131 to support body 131 and may be configured to surround body 131. Additionally, bracket 111*b* may have a bent portion that is bent to match the contour of body 131. The bent portion ensures that body 131 is firmly supported without a risk of unintentional movement. Bracket 111*b* has a through-hole, through which a fastening member penetrates to fasten bracket 111*b* to boss 111*a*. As such, when using both bracket 111*b* and boss 111*a*, heater 130 may be more stably fixed and supported within duct 100. Also, boss 111*a* serves to allow heater 130 to be spaced apart from the bottom of duct 100 by a predetermined distance, which ensures that heater 130 may contact a greater amount of air while achieving smooth air flow. Bracket 111*b* may be formed of a metal capable of withstanding heat of body 131.

A predetermined amount of water is required to generate steam in heater 130. Thus, a nozzle 150 may be added to duct 100 to eject water to heater 130.

In general, steam refers to vapor phase water generated by heating liquid water. That is, liquid water is changed into vapor phase water via phase change when water is heated above a critical temperature. On the other hand, mist refers to small particles of liquid water. That is, mist is generated by simply separating liquid water into small particles, and does not entail phase change or heating. Thus, steam and mist are clearly distinguishable from each other at least in terms of phase and temperature thereof, and have something in common only in terms of supplying moisture to an object. The mist consists of small particles of water and has a greater surface area than liquid water. Thus, mist can easily absorb heat and be changed into high temperature steam via phase change. For this reason, the washing machine may utilize, as a water supply means, nozzle 150 that can divide liquid water into small particles of water, instead of an outlet that directly supplies liquid water. Nevertheless, the washing machine may adopt a conventional outlet that supplies a small amount of water to heater 130. On the other hand, nozzle 150 may supply water, i.e. a water jet instead of mist by adjusting the pressure of water supplied to nozzle 150. In any cases, heater 130 creates an environment for steam generation, and thus may generate steam.

To generate steam, water may be supplied to heater 130 in an indirect manner. For example, nozzle 150 may supply water to a space within duct 100 rather than heater 130. The water may be transported to heater 130 via air flow provided by blower 140 for steam generation. However, since water may be adhered to an inner surface of duct 100 during transport, the supplied water does not completely reach heater 130. Also, since heater 130, as described above, has optimized conditions for steam generation by local and direct heating thereof, heater 130 may sufficiently change the supplied water into steam.

In consideration of the above mentioned reasons, for efficient steam generation, nozzle 150 may supply water to heater 130 in a direct manner. Here, nozzle 150 may supply water to heater 130 using self-ejection pressure thereof. Here, the self-ejection pressure is the pressure of water supplied to nozzle 150. The pressure of water supplied to nozzle 150 may allow water ejected from nozzle 150 to reach heater 130. That is, the water ejected from nozzle 150 is ejected to heater 130 by the ejection pressure of nozzle 150 without assistance of a separate intermediate medium. For the same reason, nozzle 150 may supply water only to heater 130. Moreover, nozzle 150 may eject mist to heater 130. As previously defined above, if nozzle 150 directly ejects mist to heater 130, effective steam generation even using ideal use of power may be achieved in consideration of an ideal environment created in heater 130. Also, if the direct ejection of mist is performed only in heater 130, this may ensure more effective steam generation.

Nozzle 150 may be oriented towards heater 130. That is, a discharge hole of nozzle 150 may be oriented towards heater 130. In this case, nozzle 150 may be arranged immediately above heater 130 or may be arranged immediately below heater 130, in order to directly supply water to heater 130. However, the water supplied from nozzle 150 (more specifically, mist), as illustrated in FIGS. 3 and 5, is diffused within a predetermined angular range according to supply pressure of water, thereby traveling a predetermined distance. On the other hand, the height of duct 100 is considerably limited to achieve a compact size of the washing machine. That is, the height of heater 130 is likewise limited. Accordingly, if nozzle 150 is arranged immediately above or immediately below heater 130, this arrangement may prevent the water ejected from nozzle 150 from being uniformly diffused throughout heater 130 in consideration of the diffusion angle and traveling distance of water. This may prevent efficient steam generation. For the same reason, the inefficient steam generation may likewise occur even when a pair of nozzles 150 is arranged at both sides of heater 130.

Alternatively, nozzle 150 may be located at both ends of heater 130, i.e. at any one of regions A and B. As described above, once blower 140 is actuated, the interior air of duct 100 is discharged from blower 140 and passes through heater 130. In consideration of the flow direction of air, region A may correspond to a region at the front of heater 130 or to a suction region, and region B may correspond to a region at the rear of heater 130 or to a discharge region. Also, region A and region B may correspond to an entrance and an exit of heater 130 respectively. Accordingly, nozzle 150 may be located in the region at the front of heater 130 or in the suction region (i.e., in region A) on the basis of the flow direction of air within duct 100. On the other hand, nozzle 150 may be located in the region at the rear of heater 130 or in the discharge region (i.e., in region B) on the basis of the flow direction of air within duct 100. Even when nozzle 150 is located in region A or region B as described above, it may be difficult for the water supplied from nozzle 150 to completely reach predetermined region S, and some of the water may remain at the outside of predetermined region S. However, when nozzle 150 is located in the region at the rear of heater 130 or in discharge region B, the water that does not reach heater 130 remains near the region at the rear of heater 130 or near discharge region B. Accordingly, if blower 140 is actuated, the water may be supplied into tub 30 rather than being changed into steam. On the other hand, when nozzle 150 is located in the region at the front of heater 130 or in suction region A, the water that does not reach heater 130 may enter heater 130 via air flow provided by blower 140. Accordingly, positioning nozzle 150 in region A may ensure efficient change of all supplied water into steam. As such, to achieve efficient steam generation, nozzle 150 may be located in region A, i.e. in the region at the front of heater 130 or in the suction region on the basis of the flow direction of air. Also, nozzle 150 located in region A is adapted to supply water in approximately the same direction as the flow direction of air within duct 100, whereas nozzle 150 located in region B is adapted to supply water in an opposite direction to the flow direction of air. Accordingly, for the same reason as discussed above, in terms of the flow direction of air, nozzle 150 may supply water to heater 130 (i.e., to predetermined region S including heater 130) in approximately the same direction as the flow direction of air within duct 100. Meanwhile, despite the above discussed reasons, nozzle 150 may be installed at any one region or two or more regions of regions A and B, regions at both sides of heater 130, and regions immediately above and below heater 130 as necessary.

As discussed above, for efficient water supply and steam generation, nozzle 150 may be configured to directly supply water to heater 130 and may be oriented towards heater 130. For the same reason, nozzle 150 may supply water in approximately the same direction as the flow direction of air within duct 100. To satisfy the above described requirements, as previously determined, it is optimal that nozzle 150 be located in region A, i.e. in the region at the front of heater 130 or in the suction region on the basis of the flow direction of air.

In the description above, nozzle 150 has been described as being located in 'approximately' the same direction as the flow direction of air. Here, the term 'approximately' means that an ejection direction of nozzle 150 corresponds to a longitudinal direction of rectangular duct 100. As illustrated in FIG. 3, duct 100 may have a streamlined rectangular shape. The water ejected from nozzle 150 is ejected in a straight line by ejection pressure, and the air flow within the streamlined duct 100 is not necessarily a straight line. Thus, the water ejected from nozzle 150 may not 'completely' coincide with the flow direction of air within duct 100. Therefore, the term 'approximately' means that the flow direction of air within duct 100 and the ejection direction of water from nozzle 150 are not contrary to each other, and more preferably means that an angle between the ejection direction of water from nozzle 150 and the flow direction of air is less than 90 degrees. Most preferably, the angle between the ejection direction of water from nozzle 150 and the flow direction of air within duct 100 is less than 45 degrees.

Region A corresponds to a region between heater 130 and blower 140 in terms of a configuration of duct 100. Thus, nozzle 150 may be located between heater 130 and blower 140 in terms of a configuration of duct 100. In other words, nozzle 150 may be located between heater 130 and an air flow generation source. That is, heater 130 and blower 140 are located respectively at one side and the other side of duct 100 so as to be opposite to each other on the basis of a longitudinal direction of duct 100. In this case, nozzle 150 is located between heater 130 provided at one side of duct 100 and blower 140 provided at the other side of duct 100. Moreover, nozzle 150 may be located between the region at the front of heater 130 and the discharge region of blower 140 (herein, the terms 'front' and 'rear' in relation to heater 130 are explained on the basis of the flow direction of air within duct 100, and assuming that the air passes a first point and a second point within duct 100, the first point where the air first reaches is defined as the region at the front and the second point where the air reaches later is defined as the region at the rear). Also, as mentioned above, the water ejected from nozzle 150 is diffused by a predetermined angle. If nozzle 150 is arranged close to heater 130, more specifically, close to the suction region of heater 130, in consideration of the diffusion angle, a great part of the ejected water will be directly supplied to the inner wall surface of duct 100 rather than heater 130. Since heater 130 has the highest temperature in predetermined region S, it is advantageous, in terms of increase in steam generation efficiency, that the greatest possible amount of ejected water directly enter heater 130 of predetermined region S and spread throughout heater 130. Thus, to assist the greatest possible amount of water in directly entering heater 130, nozzle 150 may be spaced apart from heater 130 as much as possible. When nozzle 150 is spaced apart from heater 130, in consideration of diffusion of water, the supplied water will substantially be distributed throughout heater 130 starting from the suction region of heater 130, i.e. the entrance of heater 130, which may achieve efficient use of heater 130, i.e. efficient heat exchange and steam generation. The greater the distance between nozzle 150 and heater 130, the smaller the distance between nozzle 150 and blower 140. For this reason, nozzle 150 may be located close to blower 140, and simultaneously may be spaced apart from heater 130 by a predetermined distance. Also, to ensure that nozzle 150 is spaced apart from heater 130 as much as possible, nozzle 150 may be located close to a discharge side of blower 140. That is, nozzle 150 is preferably installed close to the discharge side of blower 140 from which the air having passed through blower 140 is discharged. When nozzle 150 is located close to the discharge side of blower 140, the supplied water may be directly affected by the air flow discharged from blower 140, i.e. by discharge force of blower 140, and may be moved farther so as to uniformly contact the entire heater 130. On the other hand, with assistance of the air flow, high water pressure may not be applied to nozzle 150, which may result in a lower price and increased lifespan of nozzle 150. Moreover, to realize arrangement closer to the discharge side of blower 140, as illustrated in FIGS. 3 and 5, nozzle 150 may be installed to blower housing 113. Further, for ease of installation and repair, nozzle 150 may be installed to the separable upper housing 113*b*. As illustrated in FIG. 4, for installation of nozzle 150, upper housing 113*b* has an aperture 113*c* into which nozzle 150 is inserted. Nozzle 150 may be inserted into aperture 113*c* so as to be oriented towards heater 130.

Figure 6:
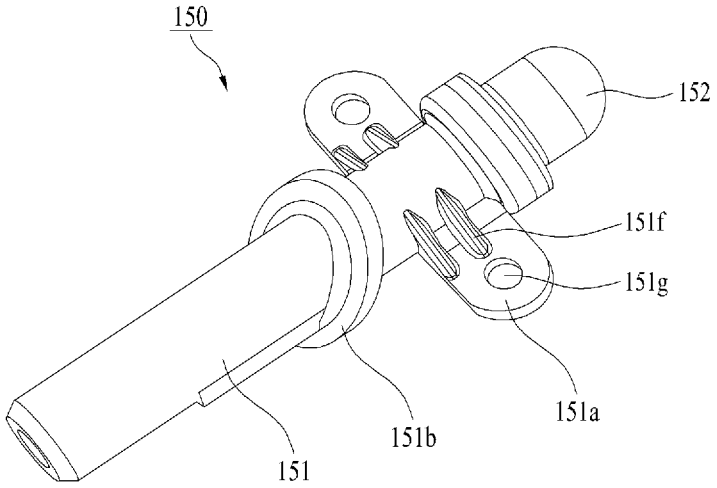
FIG. 6 is a perspective view illustrating a nozzle installed in the duct of the washing machine.
Figure 7:
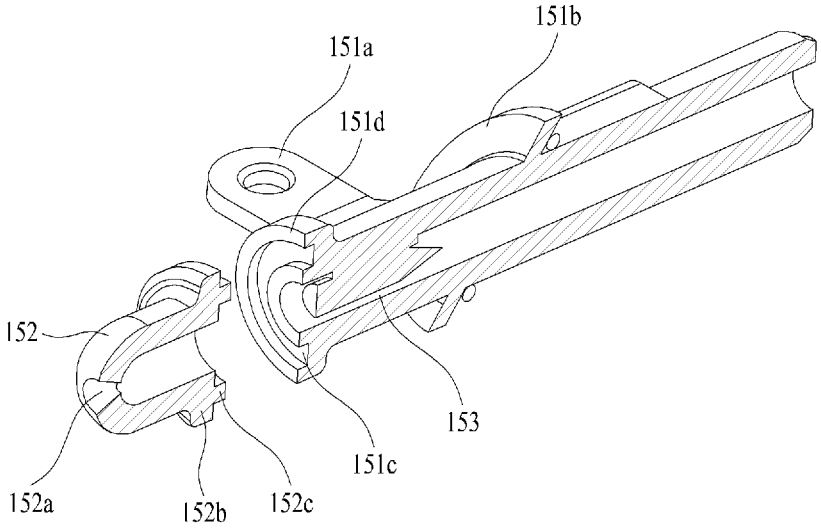
FIG. 7 is a sectional view illustrating the nozzle of FIG. 6.
Figure 8:
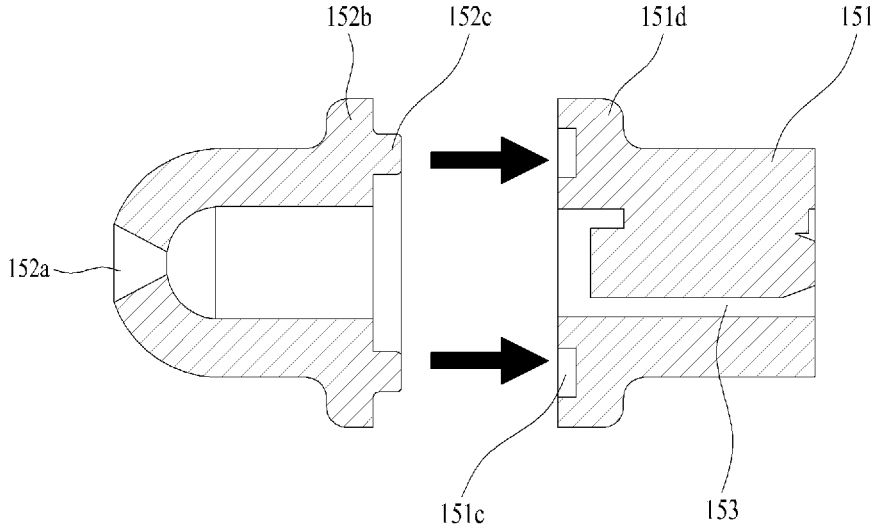
FIG. 8 is a partial sectional view illustrating the nozzle of FIG. 6.

Referring to FIGS. 6 to 8, nozzle 150 may consist of a body 151 and a head 152. Body 151 may have an approximately cylindrical shape suitable to be inserted into aperture 113*c*. Nozzle 150 is inserted into aperture 113*c*, and head 152 configured to eject water is located within duct 100. Body 151 may have a radially extending flange 151*a*. Flange 151*a* is provided with a fastening hole, by which nozzle 150 may be fastened to duct 100. To increase strength of flange 151*a*, as illustrated in FIG. 6, a rib 151*f* may be formed at body 151 to connect flange 151*a* and body 151 to each other. Additionally, body 151 may have a rib 151*b* formed at an outer periphery thereof. Rib 151*b* is caught by an edge of aperture 113*c*, which prevents nozzle 151 from being separated from duct 100, more specifically, from upper housing 113*b*. Rib 151*b* may serve to determine an accurate installation position of nozzle 150.

Head 152, as illustrated in FIGS. 7 and 8, may have a discharge hole 152*a* at a distal end thereof. When water is supplied at a predetermined pressure, discharge hole 152*a* may be designed to divide the water into small particles of water, i.e. mist. Discharge hole 152*a* may be designed to additionally apply pressure to the water to be supplied, thereby allowing the water to be diffused by a predetermined angle and to travel by a predetermined distance. The diffusion angle (a) of the water to be supplied, for example, may be 40 degrees. Head 152 may have a radially extending flange 152*b*. Similarly, body 151 may further have a radially extending flange 151*d* to face flange 152*b*. If body 151 and head 152 are formed of plastic, flanges 152*b* and 151*d* are melt-joined to each other, whereby body 151 and head 152 may be coupled to each other. If body 151 and head 152 are formed of a material other than plastic, flanges 152*b* and 151*d* may be coupled to each other using a fastening member. Also, as illustrated in FIG. 8 in detail, head 152 may have a rib 152*c* formed at flange 152*b*, and body 151 may have a groove 151*c* formed in flange 151*d*. As rib 152*c* is inserted into groove 151*c*, a contact area between body 151 and head 152 is increased. This ensures more firm coupling between body 151 and head 152. Nozzle 150, and more specifically, body 151 includes a flow-path 153 to guide the water supplied into body 151. Flow-path 153, as illustrated in FIGS. 7 and 8, may spirally extend from a distal end of body 151, i.e. from a discharge portion of body 151. Spiral flow-path 153 causes swirling water to reach head 152. As such, the water may be discharged from nozzle 150 to have a greater diffusion angle and a longer traveling distance.

When heater 130 generates steam, it may be necessary to transport the generated steam to tub 30 and drum 40 and finally to laundry, to realize desired functions. Thus, to transport the generated steam, blower 140 may blow air toward heater 130. That is, blower 140 may generate air flow to heater 130. The generated steam may be moved along duct 100 by the air flow, and may finally reach laundry by way of tub 30 and drum 40. In other words, blower 140 creates air flow within duct 100 and supplies the generated steam into tub 30 and drum 40. The steam may be used to perform desired functions, for example, laundry freshening and sterilization and creation of an ideal washing environment.

Meanwhile, as illustrated in FIGS. 9, 10, 12 and 14, duct 100 may have a recess 114 of a predetermined size. Recess 114 may be configured to accommodate a predetermined amount of water. To accommodate a predetermined amount of water, recess 114 is formed in a lower region of duct 100 and provides a predetermined volume of space. The water remaining in duct 100 may be collected into the space of recess 114. More specifically, the bottom of recess 114 may be the bottom of duct 100, and may be formed in lower part 111 of drying duct 110. Water may remain in duct 100 for several reasons. For example, some of the water supplied from nozzle 150 may remain in duct 100 rather than being changed into steam. Even if the supplied water is changed into steam, the steam may be condensed into water via heat exchange with duct 100. Also, moisture contained in the air may be condensed via heat exchange with duct 100 during drying of laundry. Recess 114 may be used to collect the remaining water. As clearly illustrated in FIG. 10, recess 114 may have a predetermined gradient to easily collect the remaining water.

Recess 114 may additionally generate steam using the water accommodated therein. Heating is required to change the accommodated water into steam. Thus, recess 114 may be located below heater 130 such that the water accommodated in recess 114 is heated using heater 130. That is, it can be said that recess 114 is located immediately below heater 130. Moreover, since the space within recess 114 is heated by heater 130, heater 130 may extend into the space within recess 114. That is, heater 130, as represented by a dotted line in FIG. 10, may include the space within recess 114. With this configuration, in addition to the steam generated using the water supplied from nozzle 150, the water in recess 114 may be heated by heater 130 and may be changed into steam. As such, a greater amount of steam may substantially be supplied, which enables more effective implementation of desired functions.

Figure 9:
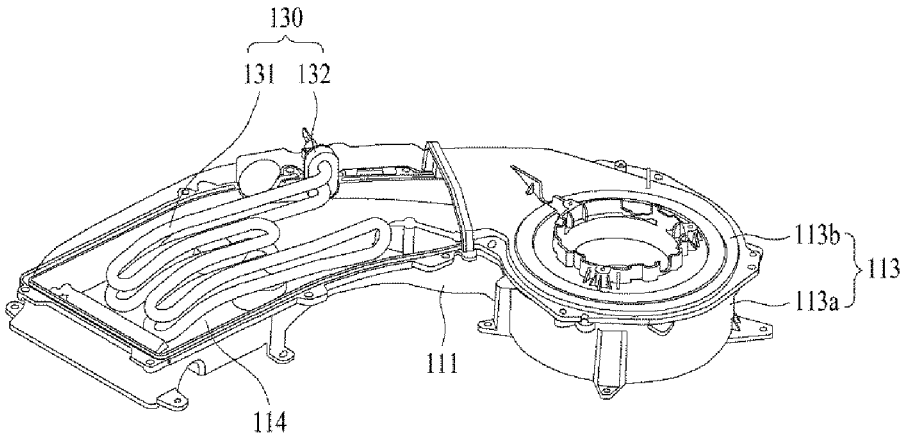
FIG. 9 is a perspective view illustrating an alternative embodiment of the duct.
Figure 10:
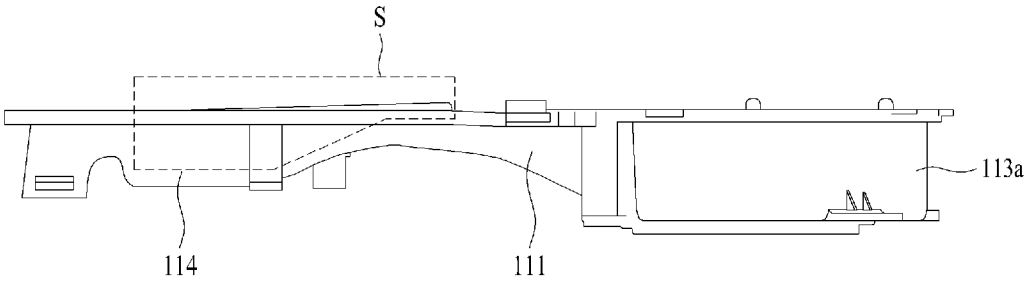
FIG. 10 is a side view illustrating the duct of FIG. 9.
Figure 11:
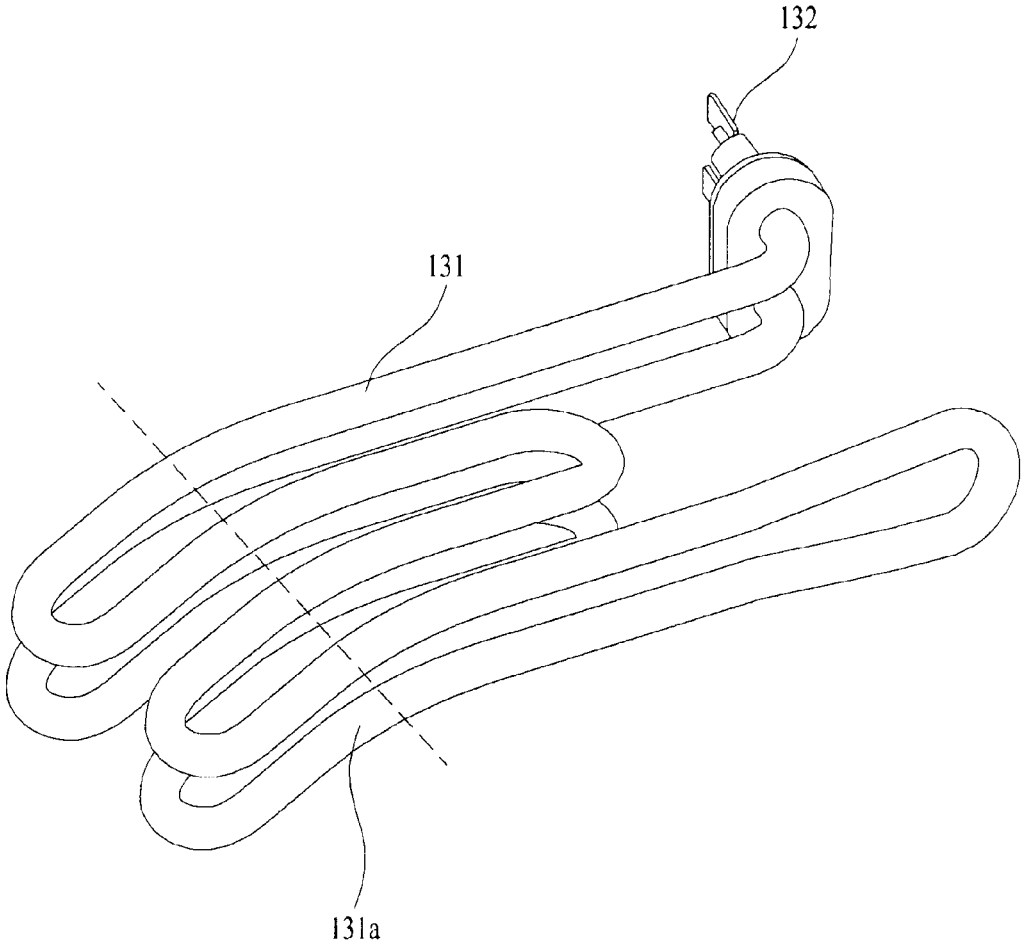
FIG. 11 is a perspective view illustrating a heater installed to the duct of FIG. 9.

More specifically, as illustrated in FIGS. 9 and 11, heater 130 may be configured to directly heat the water in recess 114. To achieve the direct heating, at least a portion of heater 130 is preferably located in recess 114. That is, when the water is accommodated in recess 114, a portion of heater 130 may be immersed in the water accommodated in recess 114. That is, heater 130 may directly contact the water in recess 114. Although heater 130 may be immersed into the water in recess 114 via various methods, as illustrated in FIGS. 9 and 11, a portion of heater 130 may be bent toward recess 114. In other words, heater 130 may have a bent portion 131*a* that is immersed in the water accommodated in recess 114. As such, bent portion 131*a* is preferably located in recess 114. In this case, bent portion 131*a* is preferably located at a free end of heater 130, and in turn recess 114 is located below bent portion 131*a*. As such, recess 114 is located below the free end of heater 130.

Figure 12:
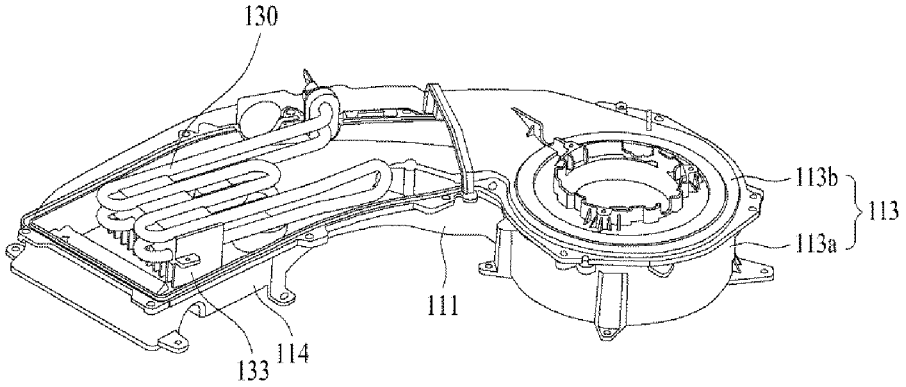
FIG. 12 is a perspective view illustrating an alternative embodiment of the duct.
Figure 13:
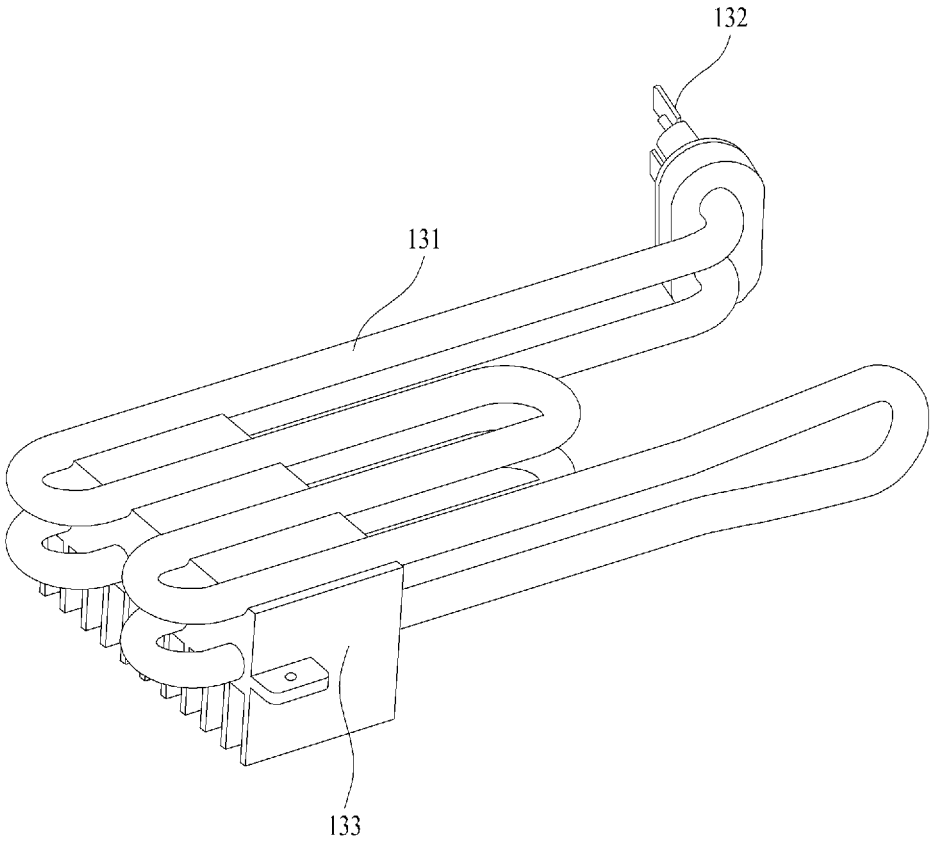
FIG. 13 is a perspective view illustrating a heater installed in the duct of FIG. 12.
Figure 14:
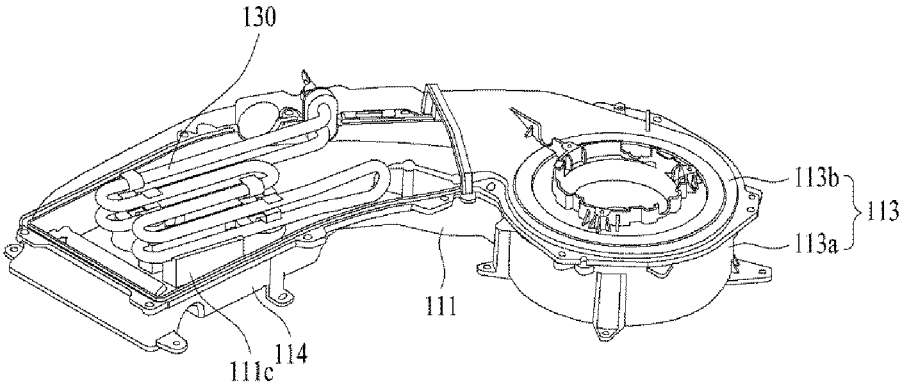
FIG. 14 is a perspective view illustrating an alternative embodiment of the duct.
Figure 15:
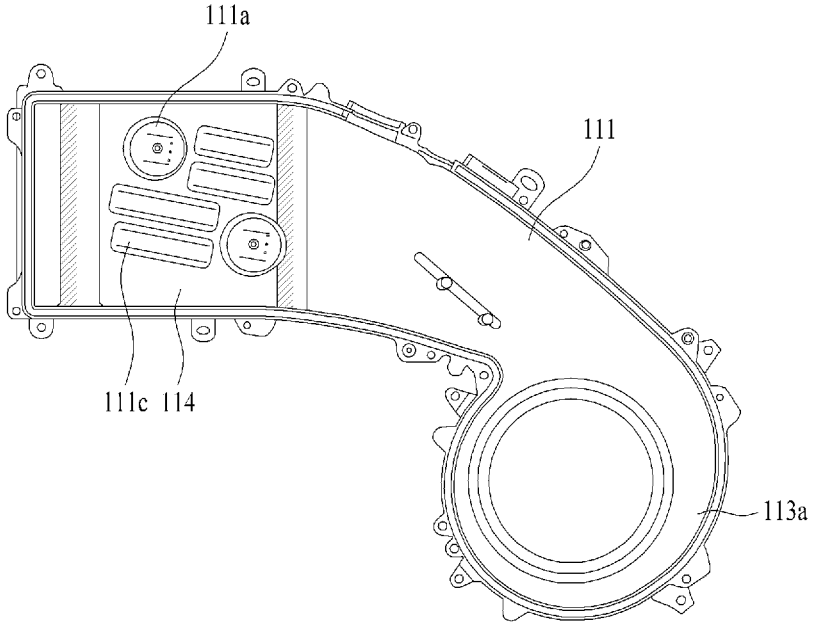
FIG. 15 is a plan view illustrating the duct of FIG. 14.

As illustrated in FIGS. 12 to 15, heater 130 may serve to indirectly heat the water in recess 114. For example, as illustrated in FIGS. 12 and 13, a thermal conductive member may be coupled to heater 130 to transfer heat from heater 130. At least a portion of the thermal conductive member is located in recess 114. As the thermal conductive member, heater 130 may include a heat sink 133 that is mounted to heater 130 and is immersed in the water accommodated in recess 114. Heat sink 133, as illustrated, has a plurality of fins, which has a configuration suitable for radiation. At least a portion of heat sink 133 is located in recess 114. As such, heat of heater 130 is transferred to the water in recess 114 through heat sink 133. Alternatively, as illustrated in FIGS. 14 and 15, heater 130 may include, as the thermal conductive member, a support member 111*c* protruding from the bottom of recess 114 to support heater 130. As mentioned above, lower part 111 may be formed of a metal having high thermal conductivity and strength. In this case, support member 111*c* may be formed of the same metal and may be integrally formed with lower part 111. Support member 111*c* may have a cavity for accommodation of heater 130, in order to stably support heater 130 and to provide the heater with a wide electric heating area. As such, heat of heater 130 is transferred to the water in recess 114 through support member 111*c*. Heater 130 comes into indirectly contact with the water in recess 114 via heat sink 133 or support member 111*c*, i.e. a thermal conductive member. More specifically, thermal conductive member 133 or 111*c* achieves thermal connection between heater 130 and the water in recess 114, thereby serving to heat the water using heater 130.

Owing to bent portion 131*a* and thermal conductive member 133 or 111*c* as mentioned above, heater 130 may directly or indirectly contact the water in recess 114, thereby serving to more effectively heat the water. Heater 130 may heat the water in recess 114 to generate steam via heat transfer through air, even without the structure for direct or indirect contact.

Through use of the steam supply mechanism as described above with reference to FIGS. 2 to 15, steam may be supplied into the washing machine, whereby, for example, laundry freshening and sterilization, and creation of an ideal washing environment may be realized. Further, many other functions may be performed by appropriately controlling, for example, steam supply timing and an amount of steam. All the above functions may be performed during a basic wash course of the washing machine. On the other hand, the washing machine may have additional courses optimized to perform the respective functions. As one example of the additional courses, hereinafter, so called a fresh course that is optimized to freshen laundry will be described with reference to FIGS. 16 to 20. To control the refresh course, the washing machine may include a controller. The controller may be configured to control all courses that can be realized by the washing machine of the present idsclosure as well as the refresh course that will be described hereinafter. The controller may initiate or stop all actuations of the respective elements of the washing machine including the above described steam supply mechanism. Accordingly, all the functions/actuations of the above described steam supply mechanism and all operations of a control method that will be described hereinafter are under control of the controller.

First, the method of controlling the refresh course may include a preparation operation S5 in which heating of heater 130 is performed. The heating may be realized by various devices, but particularly, by heater 130. Preparation operation S5 may basically create a high temperature environment that is suitable for steam generation. That is, preparation operation S5 is an operation of creating a high temperature environment for steam generation. As a result of performing preparation operation S5 to provide a high temperature environment before a steam generation operation S6 that will be described hereinafter, it is possible to facilitate steam generation in the following steam generation operation S6.

More specifically, in preparation operation S5, heater 130, which occupies a partial space within duct 100, may be heated to a higher temperature than that of the remaining space within duct 100. Preparation operation S5 requires heating for a considerably short time because a minimum space required for steam generation, i.e. only heater 130 is heated. Accordingly, preparation operation S5 may adopt temporal heating as well as local and direct heating, which may minimize power consumption. The heating of heater 130 may be performed for at least a partial duration of a preset duration of preparation operation S5 under the assumption that it can create an environment required for desired steam generation. Preferably, the heating of heater 130 may be performed for the duration of preparation operation S5.

If an external environment of heater 130 is changed during preparation operation S5, for example, if air flow occurs around heater 130, heat emitted from heater 130 may be forcibly transferred to other regions of duct 100, thereby causing unnecessary heating of these regions. Thus, local and temporal heating may be difficult. Further, it may be difficult to provide heater 130 with an environment suitable for steam generation, and excessive power consumption may be expected. For this reason, preparation operation S5 is preferably performed without occurrence of air flow around heater 130. That is, preparation operation S5 may include stopping actuation of blower 140 that generates air flow for a predetermined time. Additionally, when the air flow occurs in the entire duct 100, that is, when air circulates through duct 100, tub 30, drum 40, etc., this accentuates the above described results. Accordingly, preparation operation S5 may be performed without air circulation using duct 100. Meanwhile, the heater may not be sufficiently heated during preparation operation S5, i.e. prior to completing preparation operation S5. If water is supplied to heater 130 during preparation operation S5, a great amount of water may not be changed into steam, and thus a desired amount of steam may not be generated. Accordingly, preparation operation S5 may be performed without supply of water to heater 130. That is, preparation operation S5 may include stopping actuation of nozzle 150 that ejects water for a predetermined time. Elimination of occurrence of air flow and/or supply of water, preferably, may be maintained for the duration of preparation operation S5. However, the disclosure is not necessarily limited thereto, and elimination of occurrence of air flow and/or supply of water may be maintained for a partial duration of preparation operation S5.

To ensure creation of a high temperature environment for steam generation, preferably, actuation of heater 130 is maintained for the duration of preparation operation S5. In addition, actuation of nozzle 150 stops for at least a partial duration of the implementation duration of preparation operation S5. Preferably, actuation of nozzle 150 stops for the implementation duration of preparation operation S5. Also, actuation of blower 140 may stop for at least a partial duration of the implementation duration of preparation operation S5. Actuation of blower 140 in preparation operation S5 will be described later in relation to a first heating operation S5*a* and a second heating operation S5*b* that will be described hereinafter.

Figure 17:
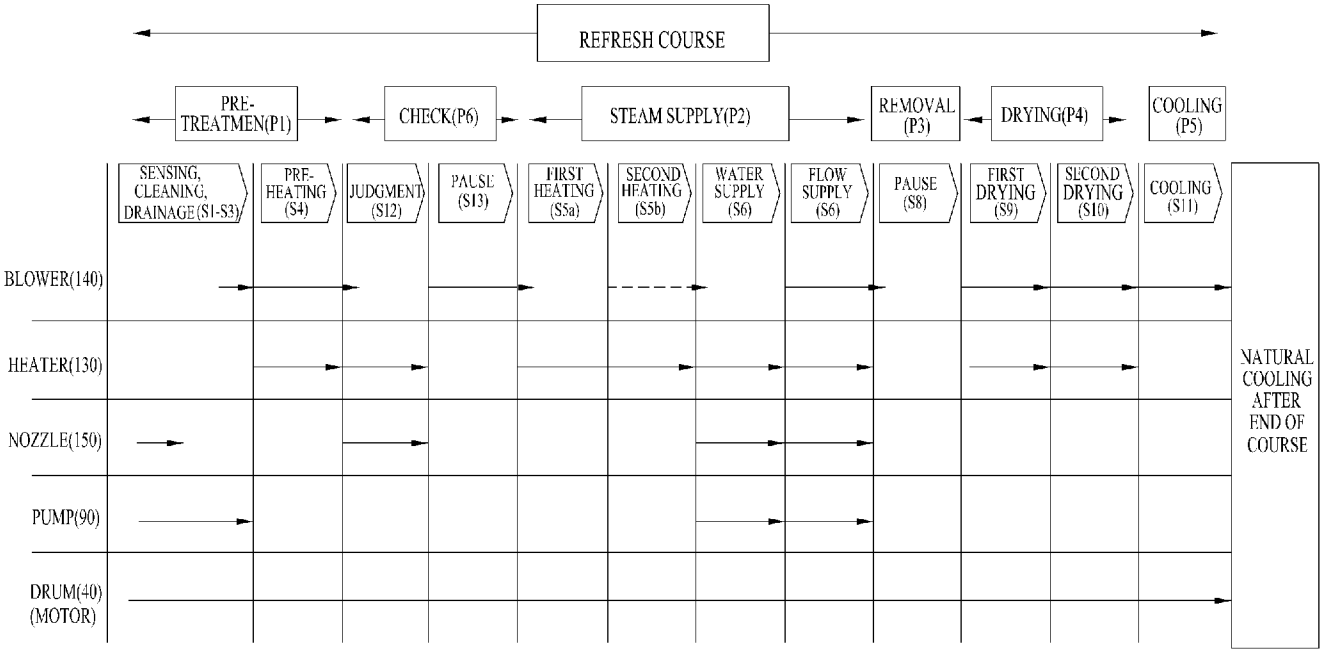
FIG. 17 is a table illustrating the control method of FIG. 16.

Elimination of occurrence of air flow and/or supply of water as described above may be achieved via various methods. However, to achieve this elimination, the steam supply mechanism, i.e. the elements within duct 100 may be primarily controlled. Control of these elements is illustrated in FIGS. 17 and 18A to 18C in more detail. FIG. 17 schematically illustrates actuation of related elements during the entire refresh course using arrows. In FIG. 17, the arrows represent actuation of the relevant elements and the duration thereof. FIGS. 18A to 18C illustrate actuation of the relevant elements during the entire refresh course in more detail by adopting numerals each representing the actual implementation time of the corresponding operation. More specifically, in FIGS. 18A to 18C, numerals in "progress time" boxes represent the time (sec) passed after starting the refresh course, and numerals written behind respective device names represent the actual actuation time (sec) of each operation.

For example, blower 140 is a major element that may generate air flow and air circulation. Thus, as illustrated in FIGS. 17 and 18B, blower 140 may be shutdown for at least a partial duration of preparation operation S5 in order to eliminate occurrence of air flow and/or air circulation with respect to heater 130. That is, blower 140 may be shutdown for the duration or for at least a partial duration of preparation operation S5. Also, as described above, nozzle 150 is a major element for supply of water within duct 100. Thus, as illustrated in FIGS. 17 and 18B, nozzle 150 may be shutdown during preparation operation S5 so as not to supply water to heater 130. Preferably, stopping actuation of blower 140 and nozzle 150 is maintained for the duration of preparation operation S5. However, stopping actuation of blower 140 and nozzle 150 may be maintained only for a partial duration of preparation operation S5. Meanwhile, heater 130 may be continuously actuated for the duration of preparation operation S5. Similarly, heater 130 may be actuated only for a partial duration of preparation operation S5.

As discussed above, occurrence of air flow may basically prevent creation of an ideal high temperature environment for steam generation. Since the high temperature environment is the most important in aspect of preparation operation S5, it may be preferable that preparation operation S5 be performed at least without occurrence of air flow. For this reason, preparation operation S5 may include stopping at least blower 140. That is, preparation operation S5 may include stopping actuation of blower 140 while actuating nozzle 150. Also, in consideration of the quality of steam to be additionally generated, at least a partial duration of preparation operation S5 may do not include an occurrence of air flow and a supply of water. That is, preparation operation S5 may include shutting down both blower 140 and nozzle 150. In this case, stopping actuation of both blower 140 and nozzle 150 may be performed at the final stage of preparation operation S5. Accordingly, steam generation operation S6 that will be described hereinafter may be performed after stopping actuation of both blower 140 and nozzle 150 ends. Meanwhile, despite the importance of elimination of the occurrence of air flow, preparation operation S5 may be performed without the supply of water under occurrence of air flow. Accordingly, preparation operation S5 may include stopping only actuation of nozzle 150 without stopping actuation of blower 140 (i.e. include shutting down only nozzle 150 while actuating blower 140). That is, preparation operation S5 may include shutting down at least nozzle 150. In this case, shutdown of nozzle 150 may be performed at the final stage of preparation operation S5. Even while actuation of blower 140 and/or nozzle 150 selectively stops, heater 130 may be continuously actuated for the duration of preparation operation S5. That is, as illustrated in FIGS. 17 and 18B, among heater 130, blower 140, and nozzle 150 as major elements of the steam supply mechanism, only heater 130 may be continuously actuated during preparation operation S5. Nevertheless, heater 130 may be actuated only for a partial duration of preparation operation S5 if it can create an environment required for desired steam generation, i.e. a high temperature environment for the partial duration.

Preparation operation S5 may be performed for a first set time. As described above, actuation of heater 130 may be maintained for at least a partial duration of the first set time of preparation operation S5. Preferably, actuation of heater 130 may be maintained for the first set time. Referring to FIG. 18B, preparation operation S5 may be performed for a very short time, for example, for 20 seconds. However, owing to the fact that preparation operation S5 may include local and direct heating of only heater 130, it is possible to create a high temperature environment suitable for steam generation with minimum power consumption even within the short time period.

After completion of preparation operation S5, steam generation operation S6 in which water is supplied to the heated heater 130 is performed. The supply of water may be realized by various devices, and more particularly, by nozzle 150. In steam generation operation S6, materials required for steam generation may be added to the previously created environment of heater 130.

To generate steam, water may be indirectly supplied to heater 130 using nozzle 150. The indirect supply of water may utilize other devices except for nozzle 150, for example, a typical outlet device. For example, water may be supplied into another space within duct 100, rather than being supplied to heater 130, using various devices, and then be transported to heater 130 for steam generation via air flow provided by blower 140. However, since water may be adhered to the inner surface of duct 100 during transport, the supplied water may do not completely reach heater 130. On the other hand, as described above, heater 130 has optimized conditions for steam generation via direct heating in preparation operation S5. Accordingly, in steam generation operation S6, water may be directly supplied to heater 130. The supply of water may be performed for at least a preset partial duration of steam generation operation S6 if it can generate a sufficient amount of steam for the preset partial duration.

However, preferably, the supply of water may be performed for the duration of steam generation operation S6. Also, as described above, generation of a sufficient amount of high quality steam requires an ideal environment, i.e. a high temperature environment. Accordingly, steam generation operation S6 preferably begins or is performed after preparation operation S5 is performed for a required time, and more specifically for a preset time. That is, preparation operation S5 is performed for a preset time before steam generation operation S6 begins.

As defined above, steam refers to vapor phase water generated by heating liquid water. On the other hand, mist refers to small particles of liquid water. That is, mist can be changed into high temperature steam via a phase change by easily absorbing heat. For this reason, in steam generation operation S6, mist may be ejected to heater 130. As described above with reference to FIGS. 6 to 8, nozzle 150 may be optimally designed to generate and supply mist. Also, as described above with reference to FIGS. 6 to 8, nozzle 150 ejects water to heater 130 by ejection pressure thereof. In steam generation operation S6, water may be ejected to heater 130 via nozzle 150 and ejection of the water from nozzle 150 to heater 130 may be achieved by ejection pressure of nozzle 150. In steam generation operation S6, water may be ejected to heater 130 via nozzle 150 that is provided between blower 140 and heater 130. Preferably, in steam generation operation S6, the water from nozzle 150 is ejected in approximately the same direction as the flow direction of air within duct 100, to ensure a supply of mist to heater 130. With the supply of mist, steam generation operation S5 may achieve efficient generation of a sufficient amount of steam from heater 130. On the other hand, nozzle 150 may supply water, i.e. a water stream or water jet instead of mist by adjusting the pressure of water supplied to nozzle 150. In any cases, heater 130 may generate steam owing to an environment thereof suitable for steam generation. A sufficient amount of water is not yet supplied during steam generation operation S6, and therefore a sufficient amount of steam may not be generated. If air flow to heater 130 occurs during steam generation operation S6, the resulting insufficient amount of steam may be supplied into tub 30 under assistance of the air flow. In particular, at the initial stage of steam generation operation S6, likewise, a sufficient amount of steam may not be generated and supplied because the supplied water is scattered by the air flow to thereby flow past heater 130. Moreover, since a predetermined time is required for change of the supplied water into steam, a great amount of liquid water may remain within heater 130 during steam generation operation S6. If air flow occurs during steam generation operation S6 as mentioned above, a great amount of liquid water as well as the steam may be transported by the air flow, thereby being supplied into tub 30. That is, in steam generation operation S6, occurrence of air flow may deteriorate the quality of steam to be supplied into tub 30, which may prevent effective implementation of desired functions. Accordingly, steam generation operation S6 may be performed without occurrence of air flow to heater 130. That is, actuation of blower 140 preferably stops in steam generation operation S6. Moreover, when air flow occurs throughout duct 100, i.e. when the air circulates through duct 100 and tub 30, etc., the above described effects may more remarkably occur. For this reason, steam generation operation S6 may be performed without air circulation. Although it is preferable that occurrence of air flow and/or air circulation (actuation of blower 140) is continuously eliminated for the duration of steam generation operation S6, occurrence of air flow and/or air circulation may be eliminated only for a partial duration of steam generation operation S6.

Meanwhile, as the water supplied during steam generation operation S6 absorbs heat emitted from heater 130, the temperature of heater 130 may drop. Such temperature drop may prevent heater 130 from having an ideal environment for steam generation. Thus, it may be difficult to generate a sufficient amount of steam and to achieve high quality steam due to the presence of a great amount of liquid water. Accordingly, it is preferable that heater 130 be heated in steam generation operation S6 in order to maintain the ideal environment for steam generation during steam generation operation S6. For this reason, steam generation operation S6 may be performed along with heating of heater 130. In this case, the heating may be performed for a partial duration of steam generation operation S6, and moreover may be performed for the duration of steam generation operation S6. Nevertheless, since heater 130 has been sufficiently heated, steam may be generated to some extent in steam generation operation S6 even without additional heating. Thus, steam generation operation S6 may be performed without additional heating of heater 130.

Although elimination of occurrence of air flow and/or implementation of heating may be performed via various methods, it may be easily achieved by controlling the steam supply mechanism, i.e. the elements within duct 100. For example, as illustrated in FIGS. 17 and 18B, blower 140 may be shut down during steam generation operation S6 in order to prevent occurrence of air flow with respect to heater 130. Preferably, stopping actuation of blower 140 may be maintained for the duration of steam generation operation S6. However, actuation of blower 140 may stop only for a partial duration of steam generation operation S6. In the case in which actuation of blower 140 stops only for a partial duration of steam generation operation S6, stopping actuation of blower 140 is preferably performed at the final stage of steam generation operation S6. That is, blower 140 may be actuated at the first half of steam generation operation S6, and actuation of the blower 140 may stop at the second half of steam generation operation S6. As described above, heater 130 is a major element to steam generation. Accordingly, as illustrated in FIGS. 17 and 18B, heater 130 may be actuated during steam generation operation S6, to generate heat required for the ideal environment of heater 130. In this case, heater 130 may be actuated at least only for a partial duration of steam generation operation S6. Preferably, heater 130 may be actuated for the duration of steam generation operation S6. Also, as mentioned above, to realize steam generation operation S6 that does not require additional heating, heater 130 may be shut down during steam generation operation S6. Stopping actuation of heater 130 may be maintained for the duration of steam generation operation S6. Preferably, nozzle 150 may be continuously actuated for the duration of steam generation operation S6. However, nozzle 150 may be actuated only for a partial duration of steam generation operation S6 if it can generate a sufficient amount of steam for the partial duration.

As discussed above, occurrence of air flow basically prevents generation of a sufficient amount of high quality steam. Since steam generation is the most important in aspect of steam generation operation S6, it may be preferable that steam generation operation S6 be performed at least without occurrence of air flow. Also, in consideration of a steam generation environment, steam generation operation S6 may be performed along with heating of heater 130 without occurrence of air flow. For these reasons, steam generation operation S6 may include stopping actuation of at least blower 140. Also, steam generation operation S6 may include stopping actuation of blower 140, but actuating heater 130.

Heater 130 has a limited size and may have difficulty in completely changing water into steam when excess water is supplied for a substantially long time. Thus, it is preferable that steam generation operation S6 be performed for a second set time that is shorter than the first set time. Actuation of nozzle 150 may be maintained for a partial duration of the second set time. Preferably, actuation of nozzle 150 is maintained for the duration of the second set time. As illustrated in FIG. 18B, steam generation operation S6 may be performed for a shorter time than in preparation operation S5, for example, for 7 seconds. With steam generation operation S6 that is performed for a short time, an appropriate amount of water may be supplied to heater 130 and be completely changed into steam.

After completion of steam generation operation S6, air may be blown to heater 130 in order to move the generated steam (S7). That is, the air flow to heater 130 may occur to allow the generated steam to be supplied into tub 30 (S7). The occurrence of air flow may be performed by various methods, but more particularly, by rotating blower 140. Thus, steam supply operation S7 performed after steam generation operation S6 is an operation of supplying the generated steam into tub 30. Steam supply operation S7 is performed after steam generation operation S6 ends. As such, preparation operation S5, steam generation operation S6, and steam supply operation S7 are performed in sequence, and the next operation is performed after completion of the previous operation.

The generated steam is moved along duct 100 by the air flow, and is primarily supplied into tub 30. Thereafter, the steam may finally reach laundry by way of drum 40. The steam is used for desired functions, for example, laundry freshening and sterilization, or creation of an ideal washing environment. If the air flow can transport all of or a sufficient amount of the generated steam into tub 30, the air flow may occur for a partial duration of steam supply operation S7. However, and preferably, the air flow may occur for the duration of steam supply operation S7. Also, as described above, due to the fact that steam supply operation S7 has a precondition of generation of a sufficient amount of steam to be supplied into tub 30, it is preferable that steam supply operation S7 begins after steam generation operation S6 is performed for a desired time, preferably, for a preset time. That is, steam generation operation S6 is performed for a preset time before steam supply operation S7 begins. Also, since steam generation operation S6 is performed after preparation operation S5 is performed for a predetermined time, steam supply operation S7 begins after preparation operation S5 and steam generation operation S6 are sequentially performed for a predetermined time.

Meanwhile, the air within tub 30 and/or drum 40 has a lower temperature than the supplied steam. The supplied steam may be condensed into water via heat exchange with the air within tub 30 and/or drum 40. Accordingly, during steam supply operation S7, a certain amount of the generated steam may be lost during transport, and may not reach laundry. Moreover, it may be difficult to provide laundry with a sufficient amount of steam and to achieve desired effects. For this reason, water may be supplied to heater 130 during steam supply operation S7 to ensure continuous steam generation. That is, steam supply operation S7 may be performed along with supply of water to heater 130. In this case, in addition to steam generation operation S6, steam is continuously generated even during steam supply operation S7. As such, a sufficient amount of water to compensate for water loss during transport may be prepared within a short time. Accordingly, despite water loss during transport, the washing machine may provide laundry with a sufficient amount of steam that the user can visually perceive, which ensures reliable acquisition of desired effects using steam. The supply of water may be performed for at least a partial duration of steam supply operation S7. Preferably, to generate a greater amount of steam, the supply of water may be performed for the duration of steam supply operation S7. If the supply of water is performed only for a partial duration of steam supply operation S7, it is preferable that the supply of water is performed at the final stage of steam supply operation S7.

Since the water supplied during steam supply operation S7 is changed into steam by absorbing heat from heater 130, temperature drop may prevent heater 130 from acquiring an ideal environment for steam generation. Thus, to maintain the ideal environment for steam generation during steam supply operation S7, it is preferable to perform heating of heater 130 even during steam supply operation S7. For this reason, steam supply operation S7 may be performed along with heating of heater 130. By maintaining the ideal environment for steam generation via heating, steam generation during steam supply operation S7 may be more stably performed to achieve a sufficient amount of steam. In this case, the heating may be performed for at least a partial duration of steam supply operation S7, and preferably, may be performed for the duration of steam supply operation S7, in order to maintain the ideal environment for steam generation. When the supply of water (actuation of nozzle 150) is performed during steam supply operation S7, preferably, actuation of heater 130 may depend on actuation of nozzle 150. That is, when steam supply operation S7 includes actuation of nozzle 150 and heater 130, actuation of nozzle 150 is preferably performed simultaneously with actuation of heater 130.

Although the supply of water and/or the heating may be performed via various methods, it may be easily achieved by controlling the steam supply mechanism, i.e. the elements within duct 100. For example, nozzle 150 and heater 130 may be actuated for at least a partial duration of steam supply operation S7, in order to achieve the supply of water and heating. In this case, actuation of nozzle 150 and actuation of heater 130 are preferably performed at the final stage of steam supply operation S7. However, as illustrated in FIGS. 17 and 18B, actuation of nozzle 150 and heater 130 is preferably maintained for the duration of steam supply operation S7, to achieve efficient steam generation and to maintain the ideal environment for steam generation.

As illustrated in FIGS. 17 and 18, blower 140 may be continuously actuated for the duration of steam supply operation S7. Moreover, blower 140, as illustrated in FIG. 18B, may be actuated for an additional time (for example, 1 second in FIG. 18B) after steam supply operation S7 begins. That is, blower 140 may be actuated for a predetermined time (for example, 1 second) at the initial stage of a pause operation S8. The additional actuation is advantageous to discharge all steam remaining within duct 100. Nevertheless, blower 140 may be actuated only for a partial duration of steam supply operation S7 if the air flow can transport all of or a sufficient amount of the generated steam into tub 30.

As described above with reference to FIGS. 6 to 8, nozzle 150 ejects water to heater 130 by ejection pressure thereof. In steam supply operation S7, water may be ejected to heater 130 via nozzle 150 and ejection of the water from nozzle 150 to heater 130 may be achieved by ejection pressure of nozzle 150. Also, in steam supply operation S7, water may be ejected to heater 130 via nozzle 150 that is provided between blower 140 and heater 130. Preferably, in steam supply operation S7, the water from nozzle 150 is ejected in approximately the same direction as the flow direction of air within duct 100, to supply mist to heater 130.

The above described steam supply operation S7 basically has a precondition in that air flow is generated within duct 100 to supply the steam generated in steam generation operation S6 into tub 30. Thus, actuation of blower 140 is maintained for at least a partial duration of steam supply operation S7, and preferably, is maintained for the duration of steam supply operation S7. In addition, actuation of heater 130 and actuation of nozzle 150 may be selectively performed in steam supply operation S7. With selective actuation of heater 130 and nozzle 150, in steam supply operation S7, only actuation of nozzle 150 may be maintained (without actuation of heater 130), only actuation of heater 130 may be maintained (without actuation of nozzle 150), or heater 130 and nozzle 150 may be actuated simultaneously. As described above, heater 130 is actuated for at least a partial duration of steam supply operation S7, and is preferably actuated for the duration of steam supply operation S7. nozzle 150 is actuated for at least a partial duration of steam supply operation S7, and is preferably actuated for the duration of steam supply operation S7.

In the case in which heater 130 and nozzle 150 are actuated simultaneously, it can be said that blower 140, heater 130 and nozzle 150 are actuated simultaneously in steam supply operation S7. In this case, actuation of blower 130, heater 130 and nozzle 150 may be performed for at least a partial duration of steam supply operation S7, and preferably, may be performed for the duration of steam supply operation S7. If actuation of blower 130, heater 130 and nozzle 150 is performed for a partial duration of steam supply operation S7, preferably, the simultaneous actuation is performed at the final stage of steam supply operation S7.

Meanwhile, water may be generated in tub 30 by the steam supplied in steam supply operation S7. For example, the air within tub 30 and/or drum 40 has a lower temperature than the supplied steam. Thus, the supplied steam may be condensed into water via heat exchange with the air within tub 30 and/or drum 40. Accordingly, even in steam generation operation S6, the generated steam may be condensed by heat exchange even within duct 100, and the condensed water may be supplied into tub 30 via air flow. Thus, the condensed water may be finally gathered in tub 30. As illustrated in FIG. 2, if sump 33 is provided in tub 30, the condensed water may be gathered in sump 33. The condensed water may cause dried laundry to be wetted, which may prevent realization of desired functions by steam supply. For this reason, the water generated by steam supply during steam generation and steam supply operations S6 and S7 may be discharged from tub 30. For drainage of water, as illustrated in FIGS. 17 and 18B, drain pump 90 may be actuated. Once drain pump 90 is actuated, the water in sump 33 may be discharged outward from the washing machine through drain hole 33*b* and drain pipe 91. The discharge of water may be performed for the duration of steam generation and steam supply operations S6 and S7. Of course, the discharge of water may be performed only for a partial duration of steam generation and steam supply operations S6 and S7 if rapid discharge of water is possible. Likewise, even drain pump 90 may be actuated for the duration of steam generation and steam supply operations S6 and S7, or may be actuated only for a partial duration of steam generation and steam supply operations S6 and S7.

Heater 130 has a limited size, and thus supplying all the steam generated in heater 130 into tub 30 does not take a great time. Thus, steam supply operation S7 may be performed for a third set time that is shorter than the second set time. Actuation of heater 130, nozzle 150, and blower 140 may be maintained for at least a partial duration of the third set time, and is preferably maintained for the duration of the third set time. In explanation based on only the actuation time of nozzle 150, the actuation time of nozzle 150 in steam generation operation S6 is set to longer than the actuation time of nozzle 150 in steam supply operation S7. In this case, the actuation time of nozzle 150 in steam supply operation S7 may be a half or a quarter of the actuation time of nozzle 150 in steam generation operation S6, and preferably may be a half or one third of the actuation time of nozzle 150 in steam generation operation S6. As illustrated in FIGS. 17 and 18B, steam supply operation S6 may be performed for a shorter time than in steam generation operation S6, for example, for 3 seconds. Through efficient implementation of desired functions in respective operations S5 to S7 as described above, implementation times of the operations may be gradually reduced as illustrated in FIG. 18B, which may minimize power consumption.

As described above, heater 130 may be continuously actuated for the duration of operations S5 to S7. However, this continuous actuation may cause heater 130 to overheat. Thus, to prevent heater 130 from overheating, the temperature of heater 130 may be directly controlled. For example, if the temperature of air within duct 100 or the temperature of heater 130 rises to 85° C., heater 130 may be shut down. On the other hand, if the temperature of air within duct 100 or the temperature of heater 130 drops to 70° C., heater 130 may again be actuated.

Meanwhile, in steam supply operation S7, to effectively transport the generated steam into tub 30, it is necessary to generate sufficient air flow to heater 130. The sufficient air flow may occur when blower 140 is rotated at predetermined revolutions per minute or more, and it takes some time for blower 140 to reach appropriate revolutions per minute. In particular, it takes the greatest time to restart rotation of blower 140 in a state in which actuation of blower 140 completely stops. However, in consideration of other related operations, steam supply operation S7 is optimally set to be performed for a relatively short time. Therefore, the actuation time of blower 140 at appropriate revolutions per minute may be shorter than the duration of steam supply operation S7. Thus, sufficient air flow may not occur during steam supply operation S7, and thus effective transport of the generated steam may not be possible. For this reason, to maximize performance of blower 140 during steam supply operation S7, blower 140 may be preliminarily rotated, i.e. actuated before steam supply operation S7. If blower 140 is previously rotated before steam supply operation S7, steam supply operation S7 may begin during rotation of blower 140. Accordingly, the revolutions per minute of blower 140 may rapidly increase to appropriate revolutions per minute at the initial stage of steam supply operation S7, which may ensure continuous occurrence of sufficient air flow.

The preliminary rotation of blower 140 may be performed in steam generation operation S6. However, as discussed above, occurrence of air flow in steam generation operation S6 is not preferable because it causes deterioration in the quantity and quality of steam. Thus, the preliminary rotation of blower 140 may be performed in preparation operation S5. That is, as illustrated in FIGS. 17 and 18B, preparation operation S5 may further include rotating, i.e. actuating blower 140 for a predetermined time. Although occurrence of air flow in preparation operation S5 does not have a direct effect on steam generation, it may prevent local heating and increase power consumption. Therefore, actuation of blower 140 may be performed only for a partial duration of preparation operation S5. Moreover, since blower 140 is not actuated during steam generation operation S6, if blower 140 is rotated only at the initial stage of preparation operation S5, rotation of blower 140 may not be maintained even due to inertia until steam supply operation S7 begins. Accordingly, actuation of blower 140 is performed at the final stage of preparation operation S5 as clearly illustrated in FIGS. 17 and 18B. Preferably, actuation of blower 140 may be performed only at the final stage of preparation operation S5.

As mentioned above, occurrence of air flow is not preferable even in preparation operation S5, and therefore actuation of blower 140 is considerably limited. Blower 140 is turned on only for a predetermined time so as to be rotated under power. After the predetermined time has passed, blower 140 is directly turned off, and continues to rotate by inertia. Also, blower 140 may be rotated at low revolutions per minute for the predetermined turn-on time thereof. Preparation operation S5 may be divided into first heating operation S5*a* and second heating operation S5*b* based on actuation of blower 140. As illustrated in FIGS. 17 and 18B, first heating operation S5*a* corresponds to the first half of preparation operation S5 and does not include actuation of blower 140. Thus, in first heating operation S5*a*, only heating of heater 130 is performed without supply of water and occurrence of air flow. Second heating operation S5*b* corresponds to the second half of preparation operation S5 and includes the above described actuation of blower 140. Thus, in second heating operation S5*b*, actuation of blower 140 and heating of heater 130 are performed simultaneously. More specifically, blower 140 is turned on so as to be rotated by power for a predetermined time, i.e. during second heating operation S5*b*. That is, air flow to heater 130 may occur in second heating operation S5*b*. However, as described above, blower 140 is actuated at low revolutions per minute, which minimizes a negative effect on heating of heater 130 due to the air flow. Meanwhile, as illustrated in FIGS. 17 and 18B, blower 140 may be continuously actuated for the duration of second heating operation S5*b*. Moreover, blower 140, as illustrated in FIG. 18B, may be actuated for an additional time (for example, 1 second in FIG. 18B) after second heating operation S5*b* begins. Thereafter, blower 140 is turned off immediately after second heating operation S5*b* ends. Once blower 140 is turned off, blower 140 is rotated by inertia during steam generation operation S6. Thus, since blower 140 is rotated at considerably low revolutions per minute during steam generation operation S6, no substantial air flow to heater 130 occurs. The inertia rotation of blower 140 is continued to steam supply operation S7. Thus, when steam supply operation S7 begins, blower 140 continues to rotate at low revolutions per minute. As such, a time required to begin rotation of the stopped blower 140 at the initial stage of steam supply operation S7 is reduced, and rapidly increasing revolutions per minute of blower 140 to an appropriate value is possible. Accordingly, sufficient air flow may continuously occur and the generated steam may be effectively transported for the duration of steam supply operation S7.

The above described actuation involves actuation of blower 140 and occurrence of air flow. Therefore, preparation operation S5 including the above described actuation is performed without supply of water to heater 130 and actuation of nozzle 150. Also, since blower 140 is rotated at low revolutions per minute, air circulation through duct 100 does not occur. Thus, preparation operation S5 may be performed without air circulation through duct 100 even during actuation of blower 140. That is, actuation of blower 140 does not have a great effect on local heating and creation of the steam generation environment in preparation operation S5. If efficient supply of a desired amount of steam may be realized in steam supply operation S7 even without actuation of blower 140, actuation of blower 140 is preferably eliminated. As discussed above, in any cases, it is most effective to perform preparation operation S5 without supply of water and occurrence of air flow. That is, actuation of blower 140 is selective, and is not essential.

Figure 16:
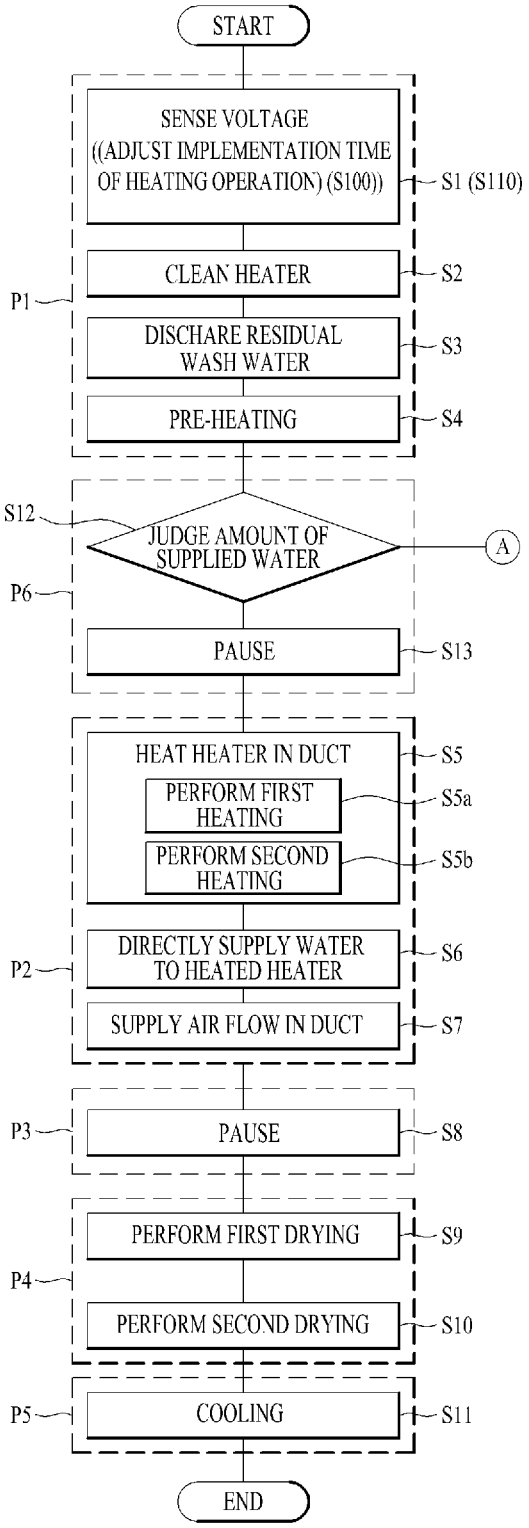
FIG. 16 is a flowchart illustrating a control method of a washing machine according to an embodiment of the present invention.

As described above, preparation operation S5, steam generation operation S6, and steam supply operation S7 are functionally associated with one another for steam supply. Thus, as illustrated in FIGS. 16, 17 and 18B, these operations S5 to S7 constitute a single functional process, i.e. a steam supply process P2. Laundry freshening effects, i.e. wrinkle-free, static charge elimination, and deodorization effects may be achieved by simply supplying a sufficient amount of steam. As described above, steam supply process P2 may achieve generation a sufficient amount of steam, and steam supply process P2 may perform desired freshening functions without additional operations that will be described hereinafter. A set of operations S5 to S7, i.e. steam supply process P2 may be repeated plural times, and a greater amount of steam may be continuously supplied into tub 30 to maximize the freshening effects. As described above with reference to FIG. 18B, steam supply process P2 may be repeated twelve times. Also, as necessary, steam supply process P2 may be repeated thirteen and fourteen times or more. Performing steam supply process P2 once requires 30 seconds, and thus performing steam supply process P2 twelve times requires about 360 seconds (or 6 minutes). However, a slight delay may occur during repetition of process P2, and an additional delay may occur for the purpose of control. Accordingly, a subsequent operation of steam supply process P2 may not begin after exactly 360 seconds.

The above described operations S5, S6, and S7 will hereinafter be described based on whether or not actuation of heater 130, of blower 140, and of nozzle 150 is performed.

Heater 130 may be actuated throughout preparation operation S5, steam generation operation S6, and steam supply operation S7. However, as in the above description of the respective operations, actuation of heater 130 is intermittently performed or stops in some operations or at least a partial duration of some operations.

Blower 140 may be actuated for at least a partial duration of steam supply operation S7, and is preferably actuated for the duration of steam supply operation S7. In addition, to achieve more rapid actuation of blower 140 in steam supply operation S7, actuation of blower 140 may be maintained for a predetermined time, i.e. for at least a partial duration of preparation operation S5, and preferably may be maintained at the final stage of preparation operation S5. In addition, actuation of blower 140 preferably stops in steam generation operation S6.

Nozzle 150 may be actuated for at least a partial duration of steam generation operation S6, and is preferably actuated for the duration of steam generation operation S6. Since actuation of nozzle 150 causes water ejection to heater 130, preferably, actuation of nozzle 150 stops in preparation operation S5 that creates a steam generation environment. Meanwhile, nozzle 150 may be actuated for at least a partial duration of steam supply operation S7, and is preferably actuated for the duration of steam supply operation S7. Although steam supply operation S7 is an operation of supplying the generated steam into tub 30, to assist the user in visually checking that a sufficient amount of steam is generated and is supplied into tub 30, actuation of heater 130, of nozzle 150, and of blower 140 may be simultaneously performed for at least a partial duration of steam supply operation S7. Preferably, actuation of heater 130, of nozzle 150, and of blower 140 may be simultaneously performed for the duration of steam supply operation S7.

In steam supply operation S6 in which nozzle 150 is actuated to generate steam without actuation of blower 140, the generated steam is invisible under an environment in which duct 100, tub 30 and drum 40 are kept at high temperatures. Thus, when only blower 140 is actuated to supply the generated steam into drum 40 after steam supply operation S6, the supplied steam is invisible even if the user views the interior of drum 40 through transparent door glass 21. Thus, the user cannot check supply of steam, which causes poor product reliability.

On the other hand, according to another embodiment of the present invention, in the case in which blower 140 is actuated during additional steam generation via actuation of nozzle 150 and heater 130 in steam supply operation S7, the interior of duct 100 and drum 40 (including tub 30) is kept at a relatively low temperature, causing at least some of the generated steam to be condensed, which has the effect of providing visible steam. That is, simultaneous actuation of nozzle 150, heater 130 and blower 140 is helpful to provide visible steam owing to creation of the relatively low temperature environment. Thus, the user can visually check the steam supplied through steam supply operation S7 through door glass 21. Allowing the user to visually check supply of steam may provide the user with product reliability.

Meanwhile, if the washing machine suitable for steam supply owing to employment of a steam supply mechanism can be previously prepared, steam supply process P2; S5 to S7 may be more efficiently performed. Thus, pre-treatment operations for preparation of the above described washing machine will be described hereinafter. In the pre-treatment operations, the above described operations S5 to S7 as well as all other operations that will be described hereinafter, if they are described as performing or eliminating any functions, this basically means that implementation or elimination of the functions is maintained for a preset duration of the corresponding operation or for a partial duration of the corresponding operation. Likewise, the same logic is applied to a description in which elements associated with the functions are actuated or shut down. Also, if any functions and/or actuation of any elements are not mentioned in the following respective operations, this may mean that the functions are not performed and the elements are not actuated, i.e. are shut down in the corresponding operation. As mentioned above, the described logic may be applied in common to all operations that are described herein.

The pre-treatment operations that will be described hereinafter may include a voltage sensing operation S1, a heater cleaning operation S2, a residual water discharge operation S3, a preliminary heating operation S4, and a water supply amount judging operation S12. operations S1, S2, S3, S4, and S12 may be performed in common before steam supply process P2, or some of operations S1, S2, S3, S4, and S12 may be selectively performed before steam supply process P2. If at least two of operations S1, S2, S3, S4, and S12 are performed before steam supply process P2, the implementation sequence of the at least two pre-treatment operations may be changed according to an actuation environment of the washing machine.

In the following description, for convenience, voltage sensing operation S1, heater cleaning operation S2, and residual water discharge operation S3 are defined as constituting a pre-treatment process P1, and water supply amount judging operation S12 is defined as a check process P6.

First, as a pre-treatment operation, duct 100 may be preliminary heated before preparation operation S5 (S4). Preliminary heating operation S4 may be performed via various methods, but may be performed via circulation of high temperature air within duct 100 and tub 30 connected to duct 100. The air circulation may be easily achieved using the elements within duct 100 that constitute the steam supply mechanism. For example, referring to FIGS. 17 and 18B, to circulate high temperature air, blower 140 and heater 130 may be actuated. If heater 130 emits heat, the heat is transferred along duct 100 by air flow generated by blower 140. Through the heat transfer and air flow, the air and the elements within duct 100 may be heated. More specifically, through the heat transfer and air flow, duct 100 (including the steam supply mechanism), tub 30, and drum 40 as well as the interior air thereof may be heated. That is, differently from preparation operation S5 in which local heating of heater 130 is achieved using heater 130, preliminary heating operation S4 may achieve substantial heating of the entire washing machine including duct 100 and the internal elements thereof as well as tub 30 and drum 40. Also, differently from preparation operation S5 that adopts direct heating of heater 130, preliminary heating operation S4 may indirectly heat the entire washing machine using air circulation. As illustrated in FIGS. 17 and 18B, blower 140 and heater 130 may be continuously actuated for the duration of preliminary heating operation S4. Meanwhile, as illustrated in FIG. 18A, blower 140 may be actuated for an additional time (for example, 1 second in FIG. 18A) after preliminary heating operation S4 begins. That is, blower 140 may be actuated for a predetermined time (for example, 1 second) at the initial stage of water supply amount judging operation S12 that will be described hereinafter.

As described above, since entire duct 100 is primarily heated by preliminary heating operation S4, it is possible to substantially prevent the steam provided by steam supply process P2; S5 to S7 from being condensed in duct 100 prior to reaching tub 30 and drum 40. Also, since preliminary heating operation S4 attempts heating of the entire tub 30 and of the entire drum 40, it is possible to prevent condensation of the steam within tub 30 and drum 40. Accordingly, a sufficient amount of steam can be supplied without unnecessary loss, enabling effective implementation of desired functions. Preliminary heating operation S4 may be performed, for example, for 50 seconds as illustrated in FIGS. 17 and 18A.

As described above, residual water of the washing machine, more particularly, within duct 100, tub 30, and drum 40 may prevent effective implementation of desired functions caused by steam supply. The residual water may also cause sudden condensation of the supplied steam and may cause dried laundry to be wetted again. For these reasons, discharge of the residual water from the washing machine may be performed (S3). Discharge operation S3 may be performed at any time before preparation operation S5. The water present in the washing machine may undergo heat exchange with high temperature air, which may deteriorate efficiency of preliminary heating operation S4. Thus, discharge operation S3, as illustrated in FIGS. 17 and 18A, may be performed before preliminary heating operation S4. To perform discharge operation S3, drain pump 90 may be actuated. Once drain pump 90 is actuated, the water within tub 30 may be discharged outward from the washing machine through drain hole 33*b* and drain pipe 91. Also, to facilitate discharge of the water, circulation of unheated air may be performed during discharge operation S3. To circulate the unheated air, only blower 140 may be actuated for a predetermined time (for example, 3 seconds) without actuation of heater 130 during discharge operation S3 (see FIGS. 17 and 18A). In this case, blower 140 is preferably actuated at the final stage of discharge operation S3. That is, blower 140 may begin to be actuated during actuation of drain pump 90 in discharge operation S3, and discharge operation S3 ends as actuation of drain pump 90 stops. During the air circulation, the unheated air, i.e. room-temperature air acts to transport the water present in duct 100, tub 30 and drum 40 by circulating through duct 100, tub 30 and drum 40, and finally to collect the water in tub 30, and more particularly, in the bottom of tub 30. If sump 33 is provided at the bottom of tub 30 as illustrated in FIG. 2, the residual water may be collected into sump 33. It is impossible to discharge the residual water from duct 100 by only actuation of drain pump 90. However, through use of the air circulation, even the water in duct 100 can be transported and discharged. Thus, the residual water can be more effectively discharged via the air circulation. Discharge operation S3 may be performed, for example, for 15 seconds as illustrated in FIGS. 17 and 18A.

During repeated actuations of the washing machine, impurities, such as lint, etc. may stick to a surface of heater 130. These impurities may prevent actuation of heater 130. For this reason, cleaning of the surface of heater 130 may be performed before preparation operation S5 (S2). Cleaning operation S2 may be performed at any time before preparation operation S5. However, cleaning operation S2 is designed to use a predetermined amount of water for efficient and rapid cleaning of heater 130, and may be performed before discharge operation S2 to enable discharge of water used for cleaning as illustrated in FIGS. 17 and 18A. More specifically, to perform cleaning operation S2, nozzle 150 ejects a predetermined amount of water to heater 130. If excess water is ejected to heater 130, an excessive amount of water may remain in duct 100, which may have a negative effect on the following operations as mentioned above. Thus, nozzle 150 may intermittently eject water to heater 130. For example, nozzle 150 may eject water for 0.3 seconds and then, be shut down for 2.5 seconds. The ejection and shutdown of nozzle 150 may be repeated, for example, four times. As a result of removing impurities from heater 130 via cleaning operation S2, stable actuation of heater 130 in the following operations, more particularly in steam supply process P2 may be achieved. Also, in cleaning operation S2, the ejected water may serve to cool the entire heater 130. As such, the entire surface of heater 130 may have a uniform temperature, which ensures more stable and effective actuation of heater 130 in the following operations. Meanwhile, as described above, a great amount of steam is continuously supplied into tub 30 in steam supply process P2. Since detergent box 15 is connected to tub 30, some of the steam may leak from the washing machine through detergent box 15. The discharged steam may burn the user and may deteriorate reliability of the washing machine. To prevent steam leakage, a predetermined amount of water is supplied into detergent box 15 in cleaning operation S2. More specifically, a valve connected to detergent box 15 is opened for a short time (for example, 0.1 seconds), and thus water may be supplied into detergent box 15. With the supplied water, the interior of detergent box 15 and the interior of a pipe that connects detergent box 15 and tub 30 to each other are wetted. As such, the steam leaked from tub 30 is condensed by moisture present in the interior of the connection pipe and the interior of detergent box 15, which prevents leakage of steam from detergent box 15. A great amount of water is used to clean heater 130 and prevent leakage of steam as described above, and residue of the water may deteriorate efficiency of the following operations. Accordingly, even during cleaning operation S2, as illustrated in FIGS. 17 and 18A, drain pump 90 may be actuated to discharge the used water. Although actuation of drain pump 90 in cleaning operation S2 may be performed for at least a partial duration of cleaning operation S2, preferably, drain pump 90 is actuated for the duration of cleaning operation S2. Cleaning operation S2 may be performed, for example, 12 seconds as illustrated in FIGS. 17 and 18A.

To realize more efficient control, voltage applied to the washing machine may be sensed (S1). Control based on the sensing of voltage will be described in more detail in the relevant part of the disclosure.

As described above, operations S1 to S4 may create an ideal environment for the following operations S5 to S7, i.e. for steam supply process P2. That is, operations S1 to S4 function to prepare steam supply process P2. Thus, as illustrated in FIGS. 16, 17, and 18A, operations S1 to S4 constitute a single functional process, i.e. pre-treatment process P1. Pre-treatment process P1 creates an ideal environment for steam generation and steam supply, and is substantially an auxiliary process of steam supply process P2. If steam supply process P2 is independently applied to supply steam to a basic wash course or other individual courses except for the laundry refresh course as mentioned above, pre-treatment process P1 may be selectively applied to these courses.

Meanwhile, steam supplied in steam supply process P2 may serve to freshen laundry via wrinkle-free, static charge elimination and deodorization owing to a desired high temperature and high humidity thereof. Nevertheless, to maximize effects of the freshening function, certain post-treatments may be additionally required. Also, since the supplied steam provides laundry with moisture, for user convenience, a post-treatment to remove moisture from the freshened laundry may be required.

As such a post-treatment, a first drying operation S9 may first be performed after steam supply operation S7. As is known, a process of rearranging fibrous tissues is required to remove wrinkles. Rearrangement of fibrous tissues requires provision of a certain amount of moisture and slow removal of moisture in fibers for a sufficient time. That is, slow removal of moisture may ensure smooth restoration of deformed fibrous tissues to an original state thereof. If fibers are dried at an excessively high temperature, only moisture may be rapidly removed from fibers, which causes deformation of fibrous tissues. For this reason, to slowly remove moisture, first drying operation S9 may dry laundry by heating the laundry at a relatively low temperature. That is, first drying operation S9 may substantially correspond to low temperature drying.

Although first drying operation S9 may be performed via various methods, it may be performed by supplying the slightly heated air, i.e. the relatively low temperature air into tub 30 for a predetermined time. The supplied heated air may finally be supplied to laundry within drum 40. The supply of heated air may be easily achieved using the elements within duct 100 that constitute the steam supply mechanism. For example, referring to FIGS. 17 and 18C, blower 140 and heater 130 may be actuated to supply heated air. If heater 130 emits heat, the surrounding air is heated by the heat, and the heated air may be transported along duct 100 by air flow provided by blower 140. The heated air may reach laundry by the air flow through tub 30 and drum 40. If heater 130 is continuously actuated, the temperature of the supplied air continuously rises, and thus it is difficult to keep the air at a relatively low temperature. Accordingly, to supply the air that is heated to a relatively low temperature, heater 130 may be intermittently actuated. For example, heater 130 may be actuated for 30 seconds and be shut down for 40 seconds, and the actuation and shutdown may be repeated. Additionally, to supply the air that is heated to a relatively low temperature, the temperature of the air or heater 130 may be directly controlled. For example, heater 130 may be actuated if the temperature of air in duct 100 or the temperature of heater 130 drops to a first set temperature. In this case, the first set temperature may be 57° C. Also, if the temperature of air within duct 100 or the temperature of heater 130 rises to a second set temperature, heater 130 may be shut down. In this case, the second set temperature is higher than the first set temperature, and for example, may be 58° C. On the other hand, as described above, the temperature of air or the temperature of heater 130 may be kept at the first set temperature or the second set temperature (for example, 57° C. to 58° C.) that is within a relatively low temperature range even by simple control of heater 130 based on the temperature. As such, in addition to the simple control of heater 130 based on the temperature, intermittent actuation of heater 130 may not be forcibly performed. Also, the interior temperature of tub 30 exceeds a room-temperature in steam supply process P2, and first drying operation S9 requires a relatively low temperature environment. Thus, as illustrated in FIGS. 17 and 18C, actuation of heater 130 may begin after blower 140 is actuated for a predetermined time (for example, 3 seconds). That is, only blower 140 is actuated for a predetermined time at the initial stage of first drying operation S9, and thereafter blower 140 and heater 130 may be actuated simultaneously.

As the slightly heated air, i.e. the relatively low temperature air is supplied to laundry by the above described first drying operation S9, fibrous tissues of the laundry may be slowly dried and rearranged. Thus, restoration of laundry having no wrinkles may be achieved. First drying operation S9 may be performed, for example, for 9 minutes and 30 seconds as illustrated in FIG. 18C to slowly dry laundry for a sufficient time.

Since the supplied steam causes the laundry to be wetted, it is necessary to completely remove moisture from the laundry. Accordingly, a second drying operation S10 is performed after first drying operation S9. To remove moisture from the laundry within a short time, second drying operation S10 may be performed to dry laundry to a high temperature, i.e. to at least a higher temperature than that in first drying operation S9. That is, second drying operation S10 may correspond to high temperature drying as compared to first drying operation S9.

Although second drying operation S10 may be performed via various methods, second drying operation S10 may be performed by supplying air having a considerably high temperature into tub 30. At least second drying operation S10 may supply air having a higher temperature than that in first drying operation S9. For example, as illustrated in FIGS. 17 and 18C, similar to first heating operation S9, blower 140 and heater 130 may be actuated to supply the heated air, i.e. the high temperature air. Differently from intermittent operation of first drying operation S9, heater 130 may be continuously actuated to continuously supply high temperature air. However, while heater 130 is continuously actuated, heater 130 may overheat. Thus, to prevent heater 130 from overheating, the temperature of air or the temperature of heater 130 may be directly controlled. For example, if the temperature of the air within duct 100 or the temperature of heater 130 rises to a higher third set temperature (for example, 95° C.) than the second set temperature, heater 130 may be shut down. On the other hand, if the temperature of the air within duct 100 or the temperature of heater 130 drops to a lower fourth set temperature (for example, 90° C.) than the third set temperature, heater 130 may again be actuated. The fourth set temperature is higher than the second set temperature and is lower than the third set temperature.

As the heated air, i.e. the high temperature air is supplied to laundry by the above described second drying operation S10, the laundry may be completely dried within a short time. Second drying operation S10 may be performed, for example, for a shorter time of 1 minute than that in first drying operation S9 as illustrated in FIGS. 17 and 18C. That is, the duration of first drying operation S9 is longer than the duration of second drying operation S10.

As described above, first and second drying operations S9 and S10 are associated with each other to provide a drying function as a post-treatment. Thus, as illustrated in FIGS. 16 and 17, these operations S9 and S10 constitute a single functional process, i.e. a drying process P4.

After steam supply process P2 is completed, a large amount of steam is present within the washing machine. As the steam is condensed, a thin water membrane is formed at surfaces of duct 100, tub 30, drum 40, and the internal elements thereof. As such, if drying operations S9 and S10 are performed after steam supply process P2, i.e. steam supply operation S7, the water membrane is easily evaporated and the resulting vapor is supplied to laundry, which may result in considerable deterioration of drying efficiency. Also, the water membrane may prevent actuation of some elements, and more particularly, of heater 130. For this reason, actuation of the washing machine is paused for a predetermined time before first drying operation S9 and after steam supply operation S7 (S8). That is, pause operation S8 is performed between steam supply operation S7 and first drying operation S9. In other words, pause operation S8 is performed between steam supply process P2 and drying process P4. As illustrated in FIGS. 17 and 18B, actuation of all elements of the washing machine except for drum 40 and a motor for rotation of drum 40 temporarily stops during pause operation S8. Thus, the water membrane formed at the elements is condensed and the resulting condensed water is collected. The condensed water is not easily evaporated differently from the water membrane, and moisture is not supplied to the laundry during drying operations S9 and S10. Removal of the water membrane may ensure normal actuation of heater 130. For this reason, pause operation S8 may prevent reduction of drying efficiency. Pause operation S8 may be performed, for example, for 3 minutes (180 seconds) as illustrated in FIG. 18B. Pause operation S8 performs an independent function to remove the water membrane from the elements, i.e. to remove moisture, and thus may be referred to as a single moisture removal process P3 similar to the other processes as defined above.

The laundry having passed through drying operations S9 and S10 acquires a high temperature by the heated air. This may burn the user by the heated laundry, and the user cannot wear the dried laundry despite completion of removal of moisture from the laundry. For this reason, the laundry may be cooled after second drying operation S10 (S11). More specifically, cooling operation S11 may supply unheated air to the laundry. For example, as illustrated in FIGS. 17 and 18C, to provide unheated air, only blower 140 may be actuated to provide flow of room-temperature air without actuation of heater 130 in cooling operation S11. The unheated air, i.e. the room-temperature air is transported through duct 100, tub 30, and drum 40 to thereby be finally supplied to the laundry. The supplied room-temperature air may serve to cool the laundry via heat exchange between the air and the laundry. As a result, the user can directly wear the freshened laundry, which increases user convenience. Also, the supplied room-temperature air may act to cool all the elements of the washing machine including duct 100, tub 30, and drum 40 to some extent. This may also substantially prevent the user from burning. Cooling operation S11 may be performed, for example, for 8 minutes as illustrated in FIG. 18B. Cooling operation S11 performs an independent function, and thus may be referred to as a single cooling process P5 similar to the other processes as defined above. As necessary, as illustrated in FIG. 17, the washing machine and the laundry may be additionally subjected to natural cooling by room-temperature air for a predetermined time after cooling operation S11.

The refresh course illustrated in FIG. 16 may be completed by continuously performing operations S1 to S11. In consideration of functions, steam supply process P2 may efficiently generate a sufficient amount of high quality steam by optimally controlling the steam supply mechanism, thereby performing desired functions of the refresh course. As auxiliary processes of steam supply process P2, pretreatment process P1 creates an ideal environment for steam generation and moisture removal process P3 creates an ideal environment for drying. Drying and cooling processes P4 and P5 perform post-treatments such as drying and cooling. With appropriate association of these processes, the refresh course may effectively perform desired functions, such as wrinkle-free, static charge elimination, and deodorization.

Meanwhile, if nozzle 150 is abnormally actuated or breaks down, the amount of water supplied to heater 130 in steam generation operation S6 of steam supply process P2 may be less than a preset value, or the supply of water may stop. Differently from other elements, abnormal actuation or breakdown of nozzle 150 may cause heater 130 to promptly overheat and damage to the washing machine. As mentioned above, abnormal actuation or breakdown of nozzle 150 may have a direct effect on the amount of water supplied into duct 100, and more specifically, the amount of water supplied into heater 130 (hereinafter referred to as 'water supply amount'), and therefore abnormal actuation or breakdown of nozzle 150 may be judged by judging the water supply amount. For this reason, as illustrated in FIGS. 16 to 18C, the refresh course may further include an operation of judging the amount of water supplied to heater 130 (S12). The refresh course including water supply amount judging operation S12 will hereinafter be described with reference to FIGS. 16 to 20.

In water supply amount judging operation S12, the amount of water ejected to heater 130 through nozzle 150 is judged. Water supply amount judging operation S12 enables direct measurement of the amount of water that is actually supplied. However, the direct measurement may require expensive devices and may increase manufacturing costs of the washing machine. Thus, water supply amount judging operation S12 may be performed by judging only whether or not a sufficient amount of water is supplied to heater 130. That is, judging operation S12 may adopt an indirect method of judging the water supply amount. As described above in relation to steam supply process P2, if water supplied from nozzle 150 is changed into steam, this naturally raises the temperature of air within duct 100. More specifically, if a preset amount of water is supplied, a sufficient amount of steam is generated and the temperature of air within duct 100 may rise to a certain level. On the other hand, if the water supply amount is reduced or the supply of water stops, a lower amount of steam may be generated and the temperature of air may drop. In consideration of this result, there is a direct correlation between the water supply amount and an increase rate in the temperature of air within duct 100. That is, a greater water supply amount causes a greater temperature increase rate, and a smaller water supply amount causes a smaller temperature increase rate. Thus, in water supply amount judging operation S12 using the indirect judgment method, the amount of water supplied to heater 130 may be judged based on a temperature increase rate within duct 100 for a predetermine duration.

As described above, a temperature increase rate caused by steam generation is judged for indirect judgment of the water supply amount in water supply amount judging operation S12. Thus, the judgment of the temperature increase rate essentially requires steam generation. For this reason, water supply amount judging operation S12 may basically include steam generation. As known, when water is changed into steam, the volume of water greatly expands. Thus, the generated steam is naturally discharged from space S occupied by heater 130. For this reason, to accurately measure a temperature increase rate, water supply amount judging operation S12 may measure and determine a temperature increase rate of air at a position close to heater 130 for a predetermined time. In other words, the temperature increase rate of air discharged from space S occupied by heater 130 for the predetermined time may be measured and determined. That is, in water supply amount judging operation S12, the temperature increase rate of air is measured based on air that is present at the outside of space S occupied by heater 130 and is mixed with and heated by the discharged steam. As the discharged air and steam directly enter discharge portion 110*a* of duct 110, the temperature increase rate of air in discharge portion 110*a* of duct 110 may be measured in water supply amount judging operation S12. That is, discharge portion 110*a* substantially means a region behind heater 130, and the temperature increase rate of air discharged rearward from heater 130 may be measured in water supply amount judging operation S12. To control drying of laundry, discharge portion 110*a* may be equipped with a sensor that measures the temperature of circulating hot air. In this case, the sensor may be used in both drying operations S9 and S10 (including a typical laundry drying operation) as well as in water supply amount judging operation S12. Thus, the above described water supply amount judging operation S12 is very advantageous for reduction in the manufacturing costs of the washing machine. Moreover, water supply amount judging operation S12 may be performed at any time during the refresh course. Also, since steam generation operation S6 performs generation of steam required for measurement of the temperature increase rate, water supply amount judging operation S12 may be performed in steam generation operation S6 during steam supply process P2. However, to rapidly and accurately judge abnormal actuation of nozzle 150, water supply amount judging operation S12 may be performed immediately before steam supply process P2, i.e. immediately before preparation operation S5 as illustrated in FIGS. 16, 17 and 18A.

Water supply amount judging operation S12 will hereinafter be described in more detail with reference to FIG. 19 based on the above described basic concept.

As described above, the water supply amount is judged using the temperature increase rate of air due to steam generation. Therefore, in water supply amount judging operation S12, first, steam is generated from heater 130 within duct 100 for a predetermined time. During steam generation, heater 130 within duct 100 is heated as described above in relation to steam supply process P2 (S12*a*). Also, water is directly ejected to the heated heater 130 for a predetermined time (S12*a*). That is, heating and supply operation S12*a* is similar to preparation operation S5 and steam generation operation S6 of the above described steam supply process P2. To perform heating and supply operation S12*a*, as illustrated in FIGS. 17 and 18A, heater 130 and nozzle 150 may be actuated. As described above in relation to preparation operation S5 and steam generation operation S6, it is preferable to supply water after implementation of heating for a predetermined time, to achieve appropriate steam generation. That is, it is preferable that nozzle 150 be actuated after heater 130 is actuated for a predetermined time. However, to rapidly measure the temperature increase rate of air in the following operations, quick steam generation may be achieved. Accordingly, as illustrated in FIGS. 17 and 18A, actuation of heater 130 and of nozzle 150 simultaneously begin in heating and supply operation S12*a*. Judging operation S12 has no intention of supplying steam as in steam supply process P2, and may not require actuation of blower 140. Heating and supply operation S12*a* may be continued for the duration of judging operation S12, and for example, may be performed for 10 seconds.

If heating and supply operation S12*a* is performed, i.e. if steam generation begins, a first temperature may be measured (S12*b*). The first temperature corresponds to the temperature of air discharged rearward from heater 130. In other words, the first temperature corresponds to the temperature of air that is present at the outside of heater 130 and is mixed with and heated by the steam discharged from heater 130. As described above, the first temperature may correspond to the temperature of air at discharge portion 110*a* of duct 100. The steam is generated as soon as heating and supply operation S12*a* begins and is naturally discharged from heater 130. Thus, measurement operation S12*b* may be performed at any time after heating and supply operation S12*a* begins. However, to achieve reliability in the measurement of the temperature increase rate, measurement operation S12*b* is preferably performed immediately after implementation of heating and supply operation S12*a*, i.e. immediately after steam generation. Meanwhile, the generation amount of steam is not significant at the initial stage of heating and supply operation S12*a*, and smooth discharge of steam from space S occupied by heater 130 may not be achieved. Thus, as illustrated in FIG. 18A, blower 140 may be actuated for at least a partial duration of heating and supply operation S12*a* corresponding to the steam generation operation. In this case, blower 140 is preferably actuated at the initial stage of heating and supply operation S12*a*. For example, blower 140 may be actuated for a short time (for example, 1 second) at the initial stage of heating and supply operation S12*a*. The steam may be smoothly discharged from heater 130 at the initial stage of heating and supply operation S12*a* by the air flow provided by blower 140. As such, heater 130, blower 140, and nozzle 150 are simultaneously actuated for a predetermined time at the initial stage of heating and supply operation S12*a*, and thereafter actuation of blower 140 stops and only heater 130 and nozzle 150 are actuated.

After completion of measurement operation S12*b*, a second temperature, which is the temperature of air discharged rearward from heater 130 after a predetermined time has passed, is measured (S12*c*). That is, after the first temperature has been measured and the predetermined time has passed, the second temperature is measured. The air, which is a measurement object in measurement operation S12*c*, is equal to the air as described above in relation to measurement operation S9*b*.

After completion of measurement operation S12*c*, the temperature increase rate may be calculated from the measured first and second temperatures (S12*d*). In general, the temperature increase rate may be acquired by subtracting the first temperature from the second temperature. The temperature increase rate of air discharged from heater 130 for the predetermined time may be determined by the above described operations S12*b* to S12*d*.

Thereafter, the calculated temperature increase rate may be compared with a predetermined reference value (S12*e*). If the calculated temperature increase rate is less than a predetermined reference value in comparison operation S12*e*, this means that the temperature increase is not sufficient. The result also means that the water supply amount is less than a predetermined value, and thus means that a sufficient amount of water is not supplied or supply of water stops, and thus a sufficient amount of steam is not generated. Accordingly, it may be judged that an insufficient amount of water less than a predetermined value is supplied if the calculated temperature increase rate is less than a predetermined reference value (S12*f*). On the other hand, if the calculated temperature increase rate is equal to or greater than the predetermined reference value in comparison operation S12*e*, this means that the temperature increase is sufficient. The result also means that the water supply amount exceeds a predetermined value, and thus a sufficient amount of water is not supplied and a sufficient amount of steam is generated. Accordingly, it may be judged that a sufficient amount of water that is at least greater than a predetermined value is supplied if the calculated temperature increase rate is equal to or greater than reference value (S12*g*). In comparison and judging operations S12*f* and S12*g*, the predetermined reference value may be experimentally or analytically acquired, and may be, for example, 5° C.

If it is judged in judging operation S12*g* that a sufficient amount of water greater than a predetermined value is supplied, normal actuation of nozzle 150 without breakdown may be judged.

Meanwhile, if it is judged in judging operation S12*e* that a sufficient amount of water greater than a predetermined value is supplied, a first algorithm to generate and supply steam into tub 30 may be performed. In addition, if it is judged in judging operation S12*e* that a sufficient amount of water less than the predetermined value is supplied, a second algorithm having no steam generation may be performed.

The first algorithm includes a steam algorithm to supply steam into tub 30, and a drying algorithm to supply hot air into tub 30. In this case, the steam algorithm includes the above described steam supply process P2, and the drying algorithm includes at least one of the above described first and second drying operations, and preferably includes both the first and second drying operations. The second algorithm include at least one of third and fourth drying operations that will be described hereinafter, and preferably includes both the third and fourth drying operations.

Figure 19:
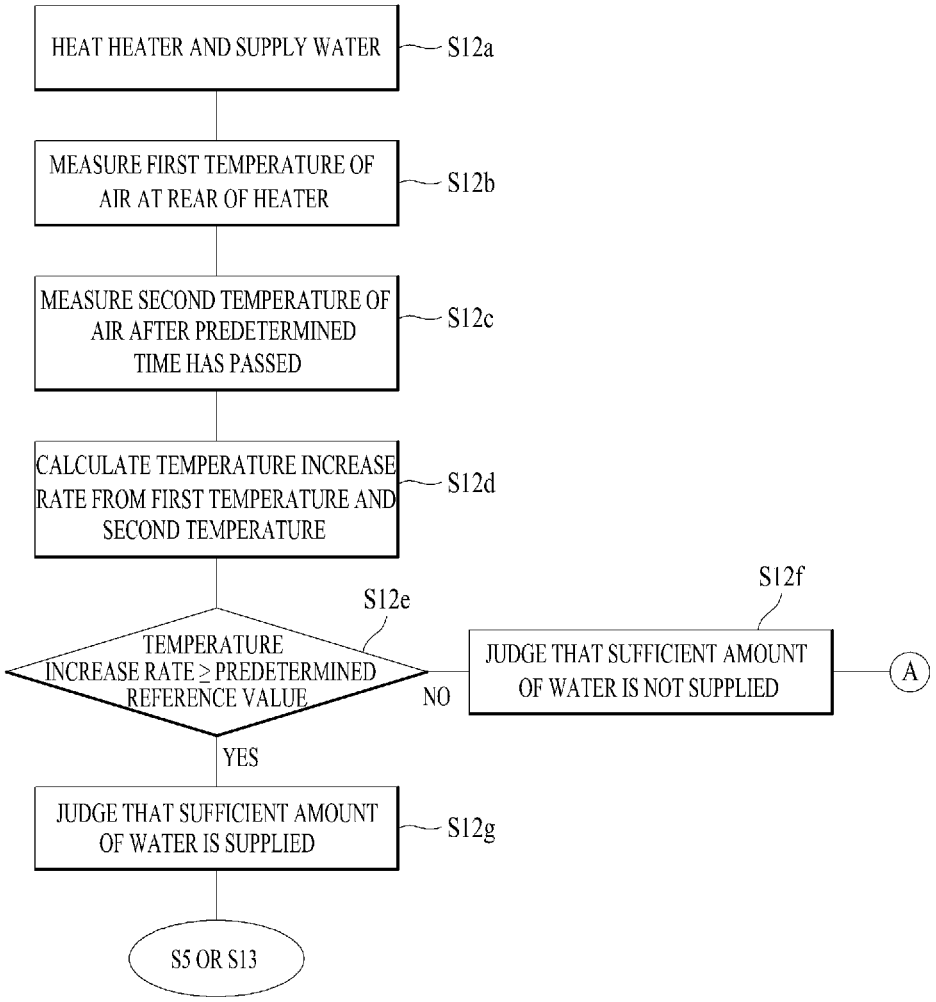
FIG. 19 is a flowchart illustrating an exemplary operation of judging the amount of supplied water.

If it is judged in judging operation S12*e* of water supply amount judging operation S12 that a sufficient amount of water greater than the predetermined value is supplied, as illustrated in FIG. 19, preparation operation S5 may be performed in succession. That is, steam supply process P2 may be performed. Then, a set of operations S5 to S7, i.e. steam supply process P2 may be a repeated preset number of times.

After completion of water supply amount judging operation S12 using steam, a great amount of steam is present within duct 100. The steam may be condensed at the surface of the elements within duct 100, thereby preventing actuation of these elements. In particular, the condensed water may prevent actuation of heater 130 during steam supply process P2. For this reason, actuation of the washing machine is paused for a predetermined time after water supply amount judging operation S12 and before implementation of the first algorithm or the second algorithm (S13). That is, pause operation S13 is performed between water supply amount judging operation S12 and preparation operation S5 of the first algorithm. As illustrated in FIGS. 17 and 18B, actuations of all the elements of the washing machine except for drum 40 and the motor for rotation of drum 40 temporarily stops during pause operation S13. Thus, the condensed water on the elements within duct 100 including heater 130 may be evaporated or naturally drops from these elements by the weight thereof. For this reason, the elements within duct 100 including heater 130 may be normally actuated in the following operations. As illustrated in FIGS. 17 and 18B, blower 140 may be actuated during pause operation S13. The air flow provided by blower 140 may facilitate removal of the condensed water. Also, the air flow serves to cool the surface of heater 130, thereby allowing the entire heater 130 to have a uniform surface temperature. Thus, heater 130 may more stably achieve desired performance in preparation operation S5 of the following first algorithm. Meanwhile, blower 140, as illustrated in FIG. 18B, may be actuated for a predetermined time (for example, 1 second) after pause operation S13 begins. That is, blower 140 may be actuated for a predetermined time (for example, 1 second) at the initial stage of preparation operation S5. Pause operation S13 may be performed, for example, for 5 seconds.

As described above, in judging operation S12, it is possible to check whether or not nozzle 150 is normal by judging the water supply amount. Pause operation S13 is a post-treatment and minimizes the effect of judging operation S12 with respect to the following operations. Thus, judging and pause operations S12 and S13 are functionally associated with one another, and constitute a single process, i.e. a check process P6 as illustrated in FIGS. 16, 17, 18A and 18B.

If it is judged in judging operation S12*e* that an insufficient amount of water less than a predetermined value is supplied (S12*f*), abnormal actuation or breakdown of nozzle 150 may be judged. The abnormal actuation of nozzle 150 may be caused by various reasons, and for example, includes the case in which the pressure of water supplied to nozzle 150 is abnormally low. The abnormal actuation or breakdown of nozzle 150, as mentioned above, may cause heater 130 to overheat and damage to the washing machine. Accordingly, if it is judged that a sufficient amount of water is not supplied as in judging operation S12*f*, actuation of the washing machine may stop for the reason of safety. Nevertheless, the refresh course may perform desired functions even in the abnormal state. In particular, if nozzle 150 can function to supply water although the water supply amount is small, the refresh course may be modified to perform desired functions. To this end, FIG. 20 illustrates alternative operations.

Figure 20:
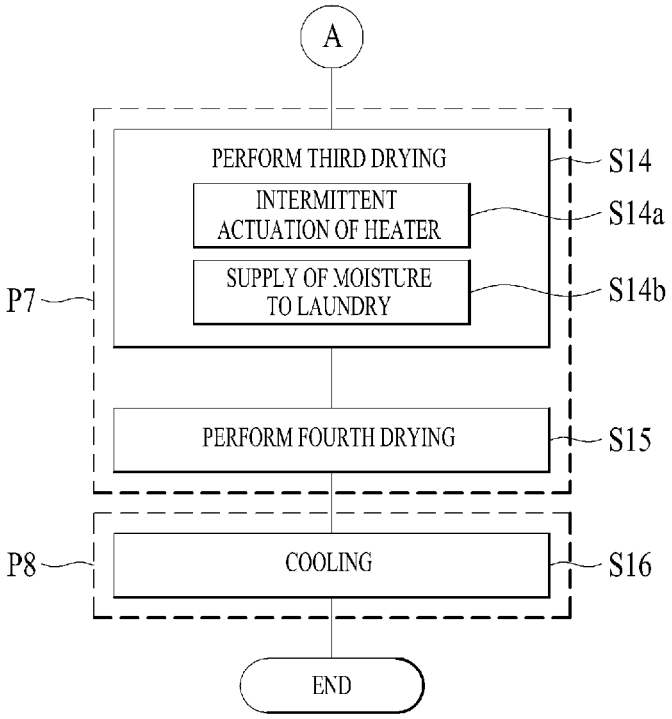
FIG. 20 is a flowchart illustrating exemplary operations to be performed when a sufficient amount of water is not supplied.
Figure 21:
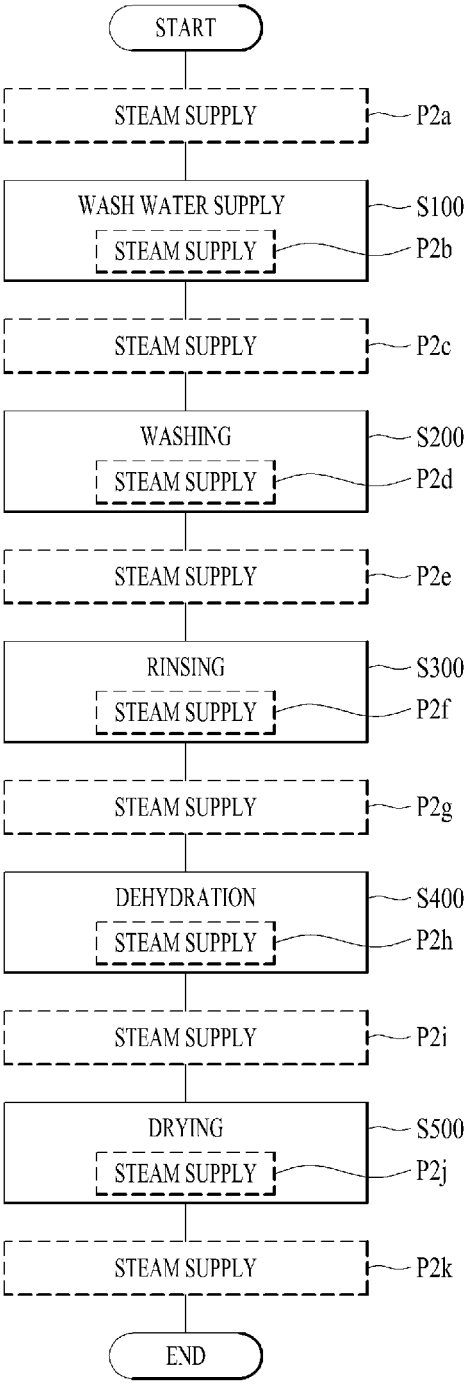
FIG. 21 is a flowchart illustrating an exemplary control method of a washing machine including a steam supply process.

As illustrated in FIG. 20, if it is judged that an insufficient amount of water less than a predetermined value is supplied (S12*f*), steam supply process P2 may no longer be performed or repeated. That is, additional generation and supply of steam stops. Instead, the second algorithm is performed. The second algorithm is an algorithm having no steam generation and includes a third drying operation S14. Since removal of wrinkles may be the most important function in the refresh course, third drying operation S14 may remove wrinkles. As described above, slow removal of moisture may ensure smooth restoration of deformed fibrous tissues to an original state thereof. If fiber is dried at an excessively high temperature, only moisture may be rapidly removed from fibers without removal of wrinkles. For this reason, to slowly remove moisture from laundry, third drying operation S14 may dry laundry by heating the laundry at a relatively low temperature. That is, third drying operation S14 may correspond to low temperature drying similar to first drying operation S9.

Third drying operation S14 may be performed by supplying the slightly heated air, i.e. the relatively low temperature air into tub 30 for a predetermined time. To supply the heated air, blower 140 and heater 130 may be actuated. Also, to supply the slightly heated air, i.e. the relatively low temperature air, heater 130 may be intermittently actuated (S14*a*). For example, heater 130 may be actuated for 40 seconds and be shut down for 30 seconds, and the actuation and shutdown may be repeated. Additionally, since third drying operation S10 is performed in a state in which high temperature steam is not supplied, the temperature of laundry and the temperature of the surrounding air in third drying operation S10 are lower than those in first drying operation S9. Accordingly, despite intermittent actuation of the same heater 130, the heater actuation time (40 seconds) in drying operation S14 is set to be longer than the heater actuation time (30 seconds) in first drying operation S9.

Similarly, stopping steam supply process P2 may not provide a sufficient amount of moisture to laundry in third drying operation S14. However, as described above, even in first drying operation S9, it is advantageous to supply a predetermined amount of moisture and remove the supplied moisture for effective removal of wrinkles. For this reason, moisture may be supplied to the laundry in third drying operation S14 (S14*b*). Supply of moisture to the laundry may be achieved by various ways. For example, vapor phase water or liquid water may be supplied to the laundry. However, as mentioned above, it is difficult to supply steam as vapor phase water in third drying operation S14. On the other hand, mist, which consists of small particles of liquid water, is sufficiently effective to supply moisture to the laundry. Thus, mist may be supplied to the laundry in moisture supply operation S14*b*. That is, the mist may be supplied into tub 30 so as to be supplied to at least the laundry. Supply of mist may be achieved by various ways. For example, if nozzle 150 can still be actuated although it is in an abnormal state, i.e. if nozzle 150 can still supply a small amount of water, nozzle 150 may eject mist. The air flow may continuously occur in order to supply heated air to laundry during third drying operation S14. That is, blower 140 may be continuously actuated during third drying operation S14. Accordingly, the mist ejected from nozzle 150 may be transported by the air flow provided by blower 140 and may reach laundry by way of duct 100, tub 30, and drum 40. The greater part of the ejected mist may be changed into steam while passing through heater 130, which ensures effective implementation of desired functions of the refresh course. As a warning for the case in which nozzle 150 completely breaks down, the washing machine may be equipped with a separate device to directly supply moisture to laundry, more particularly, to eject mist. The separate device may be actuated along with or independently of nozzle 150. The mist supplied by the separate device may be at least partially changed into steam by a high temperature environment within tub 30. Moreover, nozzle 150 and the separate device may directly supply liquid water, instead of mist, to supply moisture to laundry.

Moisture supply operation S14*b* may begin at any time during third drying operation S14. However, supplying moisture under a high temperature environment is basically advantageous to the following operation of removing the supplied moisture. Also, it is preferable that mist be ejected at as high a temperature as possible in order to partially change the supplied mist into steam. Accordingly, moisture supply operation S14*b* may be performed during heating of air to be supplied to laundry. That is, in moisture supply operation S14*b*, moisture may be supplied during actuation of heater 130 when heater 130 is intermittently actuated. That is, through intermittent actuation of heater 130, third drying operation S14 includes an actuation duration for actuation of heater 130 and a shutdown duration for shutdown of heater 130. In this case, moisture supply operation S14*b* may be performed for the actuation duration of heater 130. Moreover, to achieve more reliable effects, moisture supply operation S14*b* may be performed only while the air supplied to laundry is heated. That is, in moisture supply operation S14*b*, moisture may be supplied only for actuation of heater 130 as heater 130 is intermittently actuated. More specifically, moisture supply operation S14*b* is preferably performed for 40 seconds, for which heater 130 is actuated. More preferably, moisture supply operation S14*b* is performed for a partial duration of the final stage (for example, the last 10 seconds) of the actuation duration of heater 130, for which the highest temperature environment can be generated. If excess moisture is supplied, this causes laundry to be wetted rather than removing wrinkles from laundry. Accordingly, moisture supply operation S14*b* is performed only for a partial duration of third drying operation S14. For the same reason, preferably, moisture supply operation S14*b* is performed only for the first half of third drying operation S14. Third drying operation S14 is performed in a state in which high temperature steam is not supplied, and may be performed, for example, for 20 minutes to achieve a sufficient time for removal of wrinkles. The duration of third drying operation S14 is set to be longer than that of the similar first drying operation S9. Moisture supply operation S14*b* may be performed for the first half of third drying operation S14 of 20 minutes, i.e. for 11 minutes after third drying operation S14 begins.

It is necessary to remove moisture from laundry as the laundry is wetted by the supplied moisture. Accordingly, the second algorithm includes a fourth drying operation S15 that is performed after third drying operation S14. Fourth drying operation S15 may be substantially equal to the above described second drying operation S10 in terms of functions and detailed operations. Accordingly, all features discussed in relation to second drying operation S10 may be directly applied to fourth drying operation S15, and thus an additional description thereof will be omitted.

The above described third and fourth drying operations S14 and S15 are associated with each other to perform the freshening function when supply of steam is impossible and to provide the drying function. Accordingly, as illustrated in FIG. 20, operations S14 and S15 may constitute a single functional process, i.e. a drying and refresh process P7.

Since the laundry having passed through the above described drying operations have a high temperature due to the heated air, the laundry may be cooled after fourth drying operation S15 (S16). Cooling operation S16 may be substantially equal to the above described cooling operation S11 in terms of functions and detailed operations thereof. Accordingly, all the features discussed in relation to cooling operation S11 may be directly applied to cooling operation S16. Thus, an additional description thereof will be omitted hereinafter. Cooling operation S16 also performs an independent function, and may be referred to as a single cooling process P8 similar to the previously defined processes. As necessary, as illustrated in FIG. 17, natural cooling of the laundry and the washing machine may be additionally performed by room-temperature air after cooling operation S16.

The refresh course as illustrated in FIG. 20 includes modified operations S14 to S16 to perform desired functions even when sufficient supply of steam or steam supply itself is impossible. In the modified refresh course, instead of the steam, mist may be supplied to laundry for supply of required moisture. Also, in the modified refresh course, steam may be partially supplied. Moreover, static charge elimination as well as wrinkle-free may be achieved via appropriate actuation of the related elements. Accordingly, even when supply of steam stops, the modified refresh course may perform optimized control of the elements of the washing machine, thereby realizing desired freshening functions.

Laundry may be tumbled in at least any one of the above described operations S1 to S13. For the laundry tumbling, as illustrated in FIGS. 17 and 18A to 18C, drum 40 may be rotated. For example, drum 40 may be continuously rotated in a given direction, and laundry is lifted to a predetermined height by lifters provided at drum 40 and thereafter drops down, and this laundry movement is repeated. That is, the laundry is tumbled. Since drum 40 and the laundry within drum 40 have a great weight, they are greatly affected by inertia. Thus, rotation of drum 40 does not require continuous supply of power by the motor. Even if the motor is shut down, rotation of drum 40 and the laundry may be continued for a predetermined time by inertia. Accordingly, the motor may be intermittently actuated during rotation of drum 40. For example, as illustrated in FIGS. 17 and 18A to 18C, the motor may be driven for 16 seconds and then be shut down for 4 seconds to reduce power consumption. Rotation of drum 40 may ensure effective tumbling of laundry and effective implementation of desired functions in respective operations S1 to S13. As such, tumbling of the laundry, i.e. rotation of drum 40 may be continuously performed during all operations S1 to S13. Moreover, tumbling of laundry may be directly applied even to operations S14 to S16 for the above described modified refresh course. Also, so long as effective tumbling of the laundry is possible, other motions of drum 40 may be applied. For example, instead of the above described tumbling, drum 40 may be rotated in a given direction for a predetermined time and then is rotated in an opposite direction, and this rotation set may be continuously repeated. In addition, other motions may be applied as necessary.

Meanwhile, steam supply process P2: S3 to S5, as discussed above, may be directly applied to a basic wash course or other individual courses except for the refresh course owing to independent steam generation and supply functions thereof. FIG. 23 illustrates a basic wash course to which the steam supply process is applied. Functions of the steam supply process in the basic wash course will hereinafter be described by way of example with reference to FIG. 23.

In general, the wash course may include a wash water supply operation S100, a washing operation S200, a rinsing operation S300, and a dehydration operation S400. If the washing machine has a drying structure as illustrated in FIG. 2, the wash course may further include a drying operation S500 after dehydration operation S400.

If the steam supply process is performed before wash water supply operation S100 and/or during wash water supply operation S100 (P2*a* and P2*b*), laundry may be previously wetted by supplied steam, and supplied wash water may be heated. If the steam supply process is performed before washing operation S200 and/or during washing operation S200 (P2*c* and P2*d*), supplied steam serves to heat air and wash water within tub 30 and drum 40, thereby creating a high temperature environment advantageous to washing. If the steam supply process is performed before rinsing operation S300 and/or during rinsing operation S300 (P2*e* and P2*f*), supplied steam similarly serves to heat air and rinse water so as to facilitate rinsing. If the steam supply process is performed before dehydration operation S400 and/or during dehydration operation S400 (P2*g* and P2*h*), supplied steam mainly serves to sterilize laundry. If the steam supply process is performed before drying operation S500 and/or during drying operation S500 (P2*i* and P2*j*), supplied steam serves to greatly increase the interior temperature of tub 30 and of drum 40, thereby causing easy evaporation of moisture from laundry. As necessary, to finally sterilize laundry, steam supply process P2*k* may be performed after drying operation S500. The above described steam supply process P2*a* to P2*j* basically functions to sterilize laundry using steam. Moreover, to assist the steam supply process, preparation process P1 may also be performed.

As described above, steam supply process P2 may create an atmosphere advantageous to washing by supplying a sufficient amount of steam, which may result in a considerable improvement of washing performance. Further, steam supply process P2 may realize sterilization of laundry, and for example, may eliminate allergens.

In consideration of the above described steam supply mechanism, refresh course and basic washing course, the washing machine utilizes a high temperature air supply mechanism, i.e. a drying mechanism for steam generation and steam supply with only minimum modifications. The control method, and in particular, steam supply process P2 provides optimized control of the drying mechanism, i.e. a modified steam supply mechanism. Accordingly, the laundry machine achieves minimum modification and optimized control for efficient generation and supply of a sufficient amount of high quality steam. For this reason, the laundry machine effectively provides laundry freshening and sterilization effects, improved washing performance, and various other functions with minimized increase in manufacturing costs.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. A control method of a laundry machine, the laundry machine comprising a duct in communication with a tub and/or drum, a heater installed in the duct to be exposed to air therein, a blower installed within the duct, a nozzle located between the heater and the blower to directly eject water to the heater, and a controller, the method comprising:

activating, via the controller, the heater to heat a predetermined space to a higher temperature than a remaining space of the duct, the predetermined space including a space occupied by the heater and a surrounding space within the duct close to the heater for creating a high temperature environment suitable for steam generation, performing a steam generation by directly supplying water toward an external surface of the heater using the nozzle; and initiating, via the controller, a steam supply comprising:

generating air flow within the duct by rotating the blower, and supplying the generated steam into the tub and/or drum, wherein the steam supply at least includes a duration for which simultaneous actuation of the heater, the nozzle, and the blower is performed, and wherein the activating the heater comprises:

performing a first heating to heat only the heater without the actuation of the nozzle and the blower; and performing a second heating including:

heating the heater and actuating the blower to rotate by providing electric power to the blower for a predetermined time, and stopping the actuation of the blower by not providing the electric power to the blower before initiating the performing the steam generation by actuating the nozzle, such that the blower is rotated during the performing the steam generation by inertia that results from a rotation of the blower by the electric power in the performing the second heating, and reaches at a predetermined rotation speed immediately after the steam supply by rotating the blower is initiated.

2. The control method of claim 1, wherein the heater activation, the steam generation, and the steam supply are performed in sequence.

3. The control method of claim 1, wherein the steam supply is performed after the steam generation is completely performed.

4. The control method of claim 1, wherein an actuation time of the nozzle during the steam generation is longer than an actuation time of the nozzle during the steam supply.

5. The control method of claim 4, wherein the actuation time of the nozzle during the steam supply is a half to a quarter of the actuation time of the nozzle during the steam generation.

6. The control method of claim 1, wherein the heater, the nozzle, and the blower are simultaneously actuated for the duration of the steam supply.

7. The control method of claim 1, wherein the heater, the nozzle, and the blower are simultaneously actuated by the controller during the steam supply.

8. The control method of claim 1, wherein the steam generation includes stopping, with the controller, actuation of the blower.

9. The control method of claim 8, wherein the heater is actuated by the controller for at least a partial duration of the steam generation.

10. The control method of claim 8, wherein the heater is actuated by the controller for the duration of the steam generation.

11. The control method of claim 1, wherein actuation by the controller of the nozzle and the blower stops in the heater activation.

12. The control method of claim 1, further comprising:
preliminarily rotating, via the controller, the blower installed in the duct before the steam supply.

13. The control method of claim 1, further comprising:
preliminarily rotating, via the controller, the blower installed in the duct before the steam supply, wherein the preliminary rotation is performed during the activating the heater.

14. The control method of claim 1, wherein the steam generation and the steam supply include discharging water, generated by supply of the steam, from the tub and/or drum.

15. The control method of claim 1, wherein the steam supply process comprising the heater activation, the steam generation, and the steam supply is repeated a plurality of times.

16. The control method of claim 1, further comprising:
actuating, via the controller, the blower to circulate high temperature air through the duct, before the heater activation.

17. The control method of claim 1, further comprising:
discharging water remaining in the laundry machine, before the heater activation.

18. The control method of claim 1, further comprising:
cleaning the heater within the duct by actuating the nozzle, via the controller, before the heater activation.

19. The control method of claim 1, further comprising:
performing a first drying to supply heated air into the laundry for a predetermined time; and
performing a second drying to supply heated air into the laundry, the heated air having a higher temperature than a temperature of the air in the first drying,
wherein the first drying and the second drying are performed after the steam supply.

20. The control method of claim 19, wherein the duration of the first drying is set to be longer than the duration of the second drying.

21. The control method of claim 19, wherein implementation of the first drying includes intermittently actuating, via the controller, the heater installed within the duct, and implementation of the second drying includes continuously actuating, via the controller, the heater.

22. The control method of claim 19, further comprising:
cooling laundry by circulating unheated air, after the second drying.

23. The control method of claim 1, wherein the steam generation and the steam supply include ejecting water from the nozzle to the heater, the nozzle being located between the heater and the blower.

24. The control method of claim 1, wherein during the steam generation and the steam supply, the nozzle ejects water to the heater by ejection pressure thereof.

25. The control method of claim 1, wherein during the steam generation and the steam supply, the nozzle ejects mist to the heater.

26. The control method of claim 1, wherein the steam generation and the steam supply include ejecting water in approximately the same direction as a direction of the air flow within the duct.

* * * * *